US008764688B1

(12) United States Patent
Nauman et al.

(10) Patent No.: US 8,764,688 B1
(45) Date of Patent: Jul. 1, 2014

(54) THERAPEUTIC METHOD AND APPARATUS USING MECHANICALLY INDUCED VIBRATION

(75) Inventors: Eric A. Nauman, West Lafayette, IN (US); Jonathan M. Childress, Indianapolis, IN (US); Anne Dye Zakrajsek, Valley City, OH (US); James A. Isca, Fishers, IN (US); Daniel J. Rawson, Hales Corners, WI (US); Andrew J. Zakrajsek, Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 419 days.

(21) Appl. No.: 13/099,328

(22) Filed: May 2, 2011

Related U.S. Application Data

(60) Provisional application No. 61/329,924, filed on Apr. 30, 2010.

(51) Int. Cl.
*A61H 1/00* (2006.01)

(52) U.S. Cl.
USPC ..... 601/79; 601/46; 601/67; 601/70

(58) Field of Classification Search
USPC ..... 601/46, 49, 56–58, 65, 67–72, 74, 601/78–81
See application file for complete search history.

(56) References Cited

U.S. PATENT DOCUMENTS 3,381,683 A 5/1968 Runde
3,599,631 A * 8/1971 Werding ..... 601/18

(Continued)

FOREIGN PATENT DOCUMENTS

WO WO 98/56331 12/1998

OTHER PUBLICATIONS

Flieger, J. et al., "Mechanical Stimulation in the Form of Vibration Prevents Postmenopausal Bone Loss in Ovariectomized Rats," *Calcified Tissue International*, vol. 63, No. 6, 1998, pp. 510-514.

(Continued)

*Primary Examiner* — Justine Yu
*Assistant Examiner* — Christopher Miller
(74) *Attorney, Agent, or Firm* — Maginot Moore & Beck LLP

(57) ABSTRACT

A sleeve that provides mechanical stimulation to the arm to prevent bone density loss. A primary goal of this product is to prevent bone density loss that occurs during extended space travel. For one embodiment, only the predefined frequency specifications had to be met (between 40 Hz and 60 Hz). By meeting these frequencies for a duration of 30 minutes the product will theoretically prevent the loss of bone density. Additionally, clinical trials will need to be conducted before this product can be marketed. The product includes of several mechanical vibrators attached to a sleeve. The vibrators are small unbalanced-mass motors which are similar to those found in cell phones. The motors are encased in dome shaped housings designed to reduce lateral vibrations along the arm. The product is controlled using an Arduino board attached to the sleeve that actuates the motors. The motors, in turn, provide the specified frequency to the arm for 30 minutes. The spacing of the motor housings was determined from PEA simulations. This resulted in the motors being spaced 2 in apart along the arm at 90° increments around the axis of the arm. The controller has a display that allows for user interaction and includes a session timer. In addition, this product is contemplated for use in reducing muscle atrophy, eliminating bed sores, and treating other ailments that can result from sedentary behavior.

20 Claims, 22 Drawing Sheets

(56) References Cited

U.S. PATENT DOCUMENTS

| | | | | |
|---|---|---|---|---|
| 3,896,795 | A * | 7/1975 | Solhkhah | 601/46 |
| 4,727,878 | A | 3/1988 | Levine | |
| 5,103,806 | A * | 4/1992 | McLeod et al. | 601/2 |
| 5,514,079 | A | 5/1996 | Dillon | |
| 5,526,543 | A | 6/1996 | DiMatteo | |
| 5,545,125 | A * | 8/1996 | Tseng | 601/71 |
| 5,902,256 | A * | 5/1999 | Benaron | 601/15 |
| 6,093,164 | A * | 7/2000 | Davis et al. | 602/62 |
| 6,146,342 | A | 11/2000 | Glen | |
| 6,175,764 | B1 | 1/2001 | Loeb et al. | |
| 6,375,630 | B1 * | 4/2002 | Cutler et al. | 601/57 |
| 2003/0176822 | A1 | 9/2003 | Morgenlander | |
| 2004/0260211 | A1 * | 12/2004 | Maalouf | 601/15 |
| 2005/0033112 | A1 * | 2/2005 | Bruton et al. | 600/38 |
| 2005/0059909 | A1 | 3/2005 | Burgess | |
| 2005/0070827 | A1 * | 3/2005 | Lee | 601/57 |
| 2005/0251068 | A1 * | 11/2005 | Mor | 601/71 |
| 2005/0277856 | A1 * | 12/2005 | Munro | 601/57 |
| 2006/0106313 | A1 | 5/2006 | Hobson | |
| 2008/0319359 | A1 | 12/2008 | Moomiaie-Qajar et al. | |
| 2009/0069727 | A1 * | 3/2009 | Neustaedter et al. | 601/46 |
| 2009/0221943 | A1 | 9/2009 | Burbank et al. | |
| 2010/0249637 | A1 * | 9/2010 | Walter et al. | 600/544 |

OTHER PUBLICATIONS

Jankovich, J., "The Effects of Mechanical Vibration on Bone Development in the Rat," *Journal of Biomechanics*, vol. 5, No. 3, May 1972, pp. 241-250.

Qassem, W. et al, "Vibration Effects on Setting Pregnant Women-Subjects of Various Masses," *Journal of Biomechanics*, vol. 29, No. 4, Apr. 1996, pp. 493-501.

"Piezoelectrics in Positioning: Tutorial on Piezotechnology in Nanopositioning Applications," © 2008 Physik Instrumente (PI) Gmbh & Co., 47 pages.

Rasmussen, G., "Human Body Vibration Exposure and Its Measurement,"[online], c. 1983. Retrieved from the Internet: http://www. Zainea.com/body.htm, 27 pgs.

Forrest Cook, G., "PWM Motor Speed Controller/DC Light Dimmer," [online], © 1999 [retrieved from the Internet Aug. 31, 2011]. Retrieved from the Internet: http://www.solorb.com/elect/solarcirc/pwm1/, 5 pgs.

"Key Statistics for North America," [online] © International Osteoporosis Foundation 2010 [retrieved from the Internet Aug. 31, 2011]. Retrieved from the Internet: http://www.iofbonehealth.org/facts-and-statistics.html#factsheet-category-23, 1 pg.

Mobley, L.R. et al., "Cost-Effectiveness of Osteoporosis Screening and Treatment with Hormone Replacement Therapy, Raloxifene, or Alendronate," *Medical Decision Making*, Mar./Apr. 2006, vol. 26, No. 2, pp. 194-206. http://www.ncbi.nlm.nih.gov/pubmed/16525173.

"Bone and Joint Initiative USA, USBJD Research Activities: Trauma Condition Kit," [online], Aug. 28, 2005 [retrieved from the Internet Aug. 31, 2011]. Retrieved from the Internet: http://www.usbjd.org/research/research_op.cfm?dirID=211, 8 pgs.

"Fractures/Broken Bones Data," [online], undated [retrieved from the Internet Sep. 15, 2011]. Retrieved from the Internet: http://www.schwebel.com/practice/broken-bone-injuries/statistics/, 1 pg.

"Pressure Sores: Merck Manual Home Edition," [online], © 2010-2011 [retrieved from the Internet Sep. 15, 2011]. Retrieved from the Internet: http://www.merckmanuals.com/home/print/skin_disorders/pressure_sores/pressure_sores.html 4 pgs.

"Mortality Statistics > Decubitus ulcer (most recent) by country," [online], © 2003-2011 [retrieved from the Internet Sep. 15, 2011]. Retrieved from the Internet: http://www.nationmaster.com/graph/mor_dec_ulc-mortality-decubitus-ulcer, 2 pgs.

"How Many Hospital Patients Suffer From Bed Sores?," [online], © 2011 Rosenfeld Law Offices, LLC [retrieved from the Internet Sep. 15, 2011]. Retrieved from the Internet: http://www.bedsorefaq.com/how-many-hospital-patients-suffer-from-bed-sores/, 1 pg.

"Pulse Width Modulation Tutorial," [online], © 2010 Ricky's World [retrieved from the Internet Sep. 15, 2011]. Retrieved from the Internet: http://www.8051projects.net/pulse-width-modulation/, 7 pgs.

VenaFlow® system 30A, 30AXL, 30AXXL Operators Manual, c. Apr. 4, 2001, Aircast Incorporated, 26 pgs.

Dillon, R., "Improved Hemodynamics Shown by Continuous Monitoring of Electrical Impedance During External Counterpulsation with the End-Diastolic Pneumatic Boot and Improved Ambulatory EKG Monitoring After 3 Weeks of Therapy," *Angiology, The Journal of Vascular Diseases*, vol. 49, No. 7, Jul. 1998, 13 pgs.

* cited by examiner

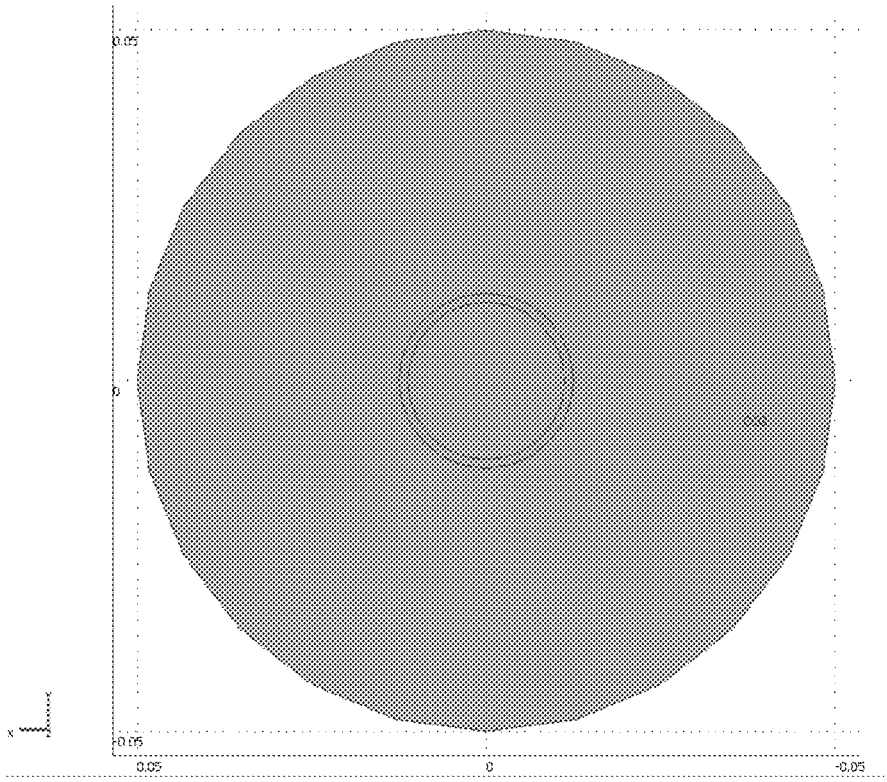
FIG. 6
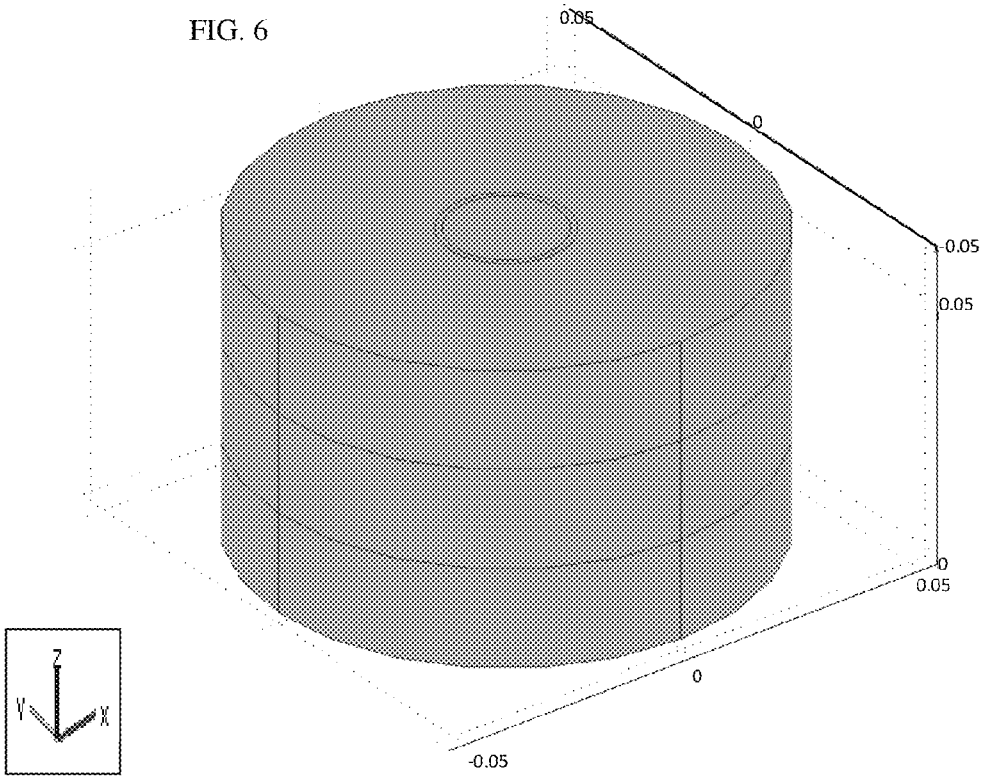

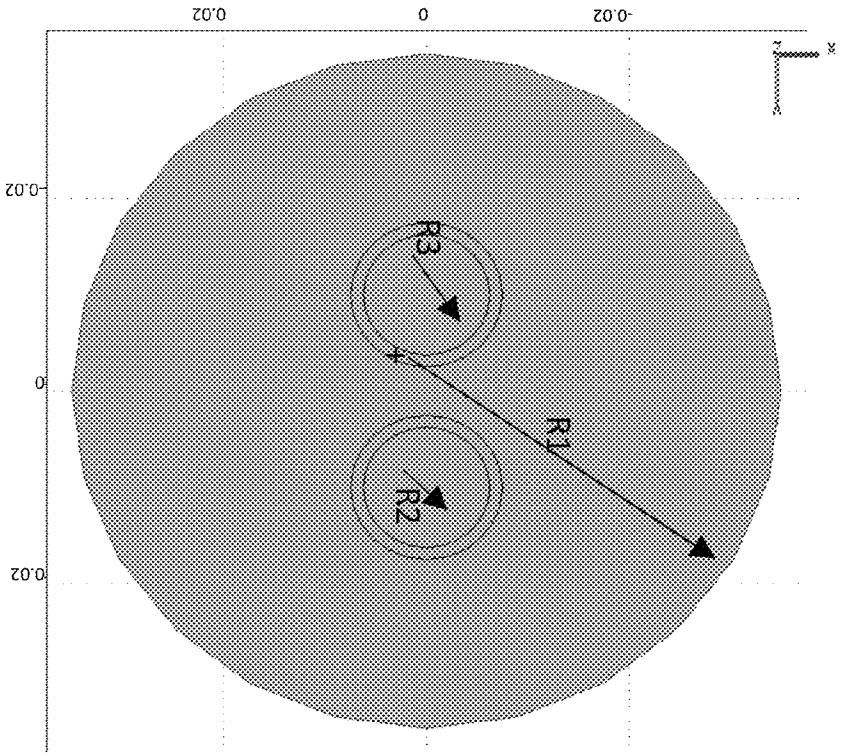
FIG. 7
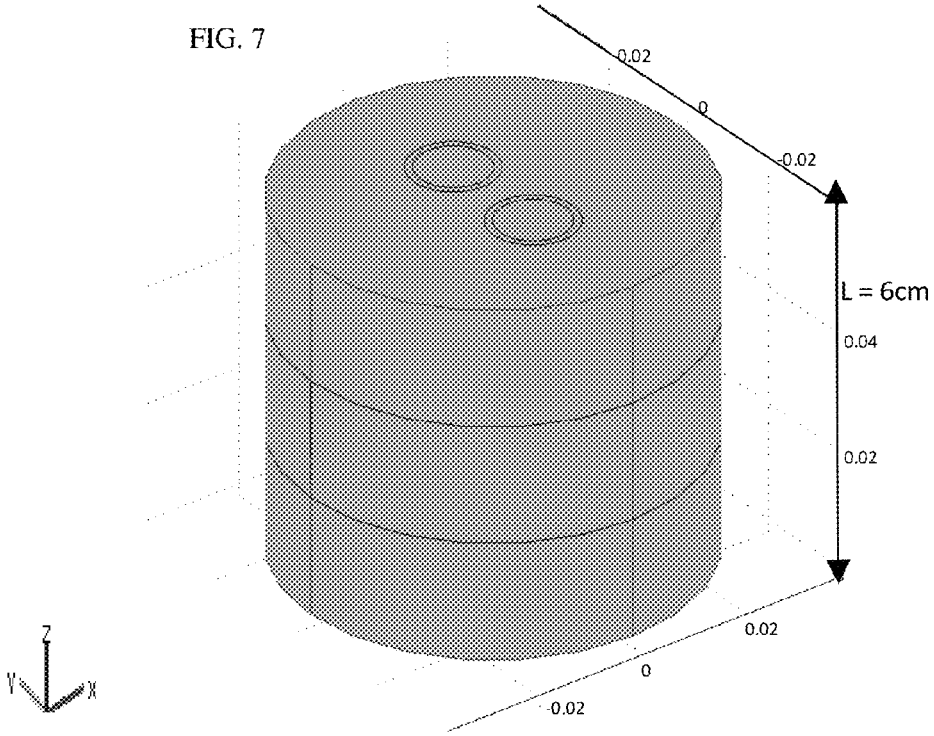

THERAPEUTIC METHOD AND APPARATUS USING MECHANICALLY INDUCED VIBRATION

CROSS-REFERENCE TO RELATED APPLICATION

This application claims the benefit of Provisional Patent Application No. 61/329,924, filed Apr. 30, 2010, which application is hereby incorporated by reference along with all references cited therein.

BACKGROUND OF THE INVENTION

This invention relates to systems and methods for providing therapy for physical ailments and disorders via mechanical stimulation.

One particular condition which is a significant problem in need of more innovative solutions is bone density loss resulting from, e.g., insufficient physical activity. For example, bone density atrophy is a significant problem for astronauts during extended space travel. Medical patients and others who have sedentary behavior also experience issues with decreasing bone density over time. According to Wolff's Law of Bone Remodeling, bone density will decrease in the absence of proper loading on the bones. Likewise, bone density will increase with an increase in loading on the bones. In the case of extended space travel, the human body must operate in the absence of gravity, and, as a result, bones do not experience the natural loading required to maintain healthy bone density. Astronauts are thus exposed to the risk of a significant loss in bone density, increasing the chance of fracture, osteoporosis, and other adverse effects, both in space and upon their return. There is a great need for a convenient, noninvasive solution for bone density loss due to extended weightlessness, or due to other conditions including sedentary behavior and the aging process.

Pressure ulcers represent another significant health care problem, affecting approximately 7.3 million Americans per year. Pressure ulcers develop from restricted blood flow to tissue, which reduces the local concentration of oxygen and nutrients and eventually leads to breakdown of the extracellular matrix. They are most commonly associated with conditions such as diabetes mellitus and those that force long-term bed rest or confinement such as spinal cord injury. There has reportedly been a steady increase in the prevalence of pressure ulcers over the last twenty years and, in fiscal year 2007, Medicare and Medicaid alone reportedly spent over 11 billion dollars on the treatment of pressure ulcers. Currently pressure ulcers are prevented primarily through the use of foams, specialty beds, and the periodic repositioning of patients. Specialty beds are also the most common method of treatment although more extreme measures include negative suction therapy, and surgery. The complexity and expense of specialty beds make it difficult for patients, hospitals, and nursing homes to afford and maintain them. The medical community is in need of both a preventative measure and treatment that is inexpensive, noninvasive, and easy to use and maintain.

SUMMARY OF THE INVENTION

The present invention provides a new therapeutic method and apparatus using mechanically induced vibration. One aspect of the invention involves applying Wolff's Law of Bone Remodeling, i.e., applying a load to a bone and thereby causing bone tissue growth to be stimulated to resist the load.

The load is applied with a garment, e.g., a sleeve, that mechanically induces vibration in the bones in a body part including but not limited to an arm, leg or other limb of a human subject. In this context, the word "sleeve" comprehends a sleeve on an arm or hand as well as a stocking or legging on a leg or foot, in each case partially or completely surrounding the limb or other affected body part. The mechanical stimulation is believed to activate the high frequency twitch muscles and apply an inertial load to the bone, the combined effect of which is believed to provide enough stimuli to substantially prevent bone density loss in the absence of gravity.

One embodiment of the garment is a multilayer sleeve configured to generally conform to the shape of a human body part or a part of another living body, with a first layer adapted for skin contact and a second layer over the first layer. A plurality of motor housings are attached to the second layer of the sleeve, and a plurality of unbalanced-mass motors are respectively mounted within the plurality of housings with the rotational axis of each unbalanced-mass motor substantially parallel to a surface of the second layer such that vibrational forces generated by each motor are substantially perpendicular to the underlying skin surface during use. Other garment embodiments include but are not limited to compression shirts, shorts and the like.

Another aspect of the invention is a noninvasive method of treating or preventing pressure ulcers. The comprises mechanically inducing a therapeutic level of vibration within a portion of a living body in need of treatment for pressure ulcers or susceptible to pressure ulcers, using a plurality of unbalanced-mass motors distributed about the skin surface of the affected body portion, with the rotational axis of each unbalanced-mass motor substantially parallel to the underlying skin surface such that vibrational forces generated by each motor are substantially perpendicular to the underlying skin surface.

Other objects and advantages of the present invention will be apparent from the following description of preferred embodiments taken in conjunction with the accompanying drawings.

BRIEF DESCRIPTION OF THE DRAWINGS

FIG. 6 illustrates an initial finite element analysis (FEA) model for a segment of an upper arm;

FIG. 7 illustrates an initial FEA model for a segment of a forearm;

DETAILED DESCRIPTION OF PREFERRED EMBODIMENTS

Figure 1:
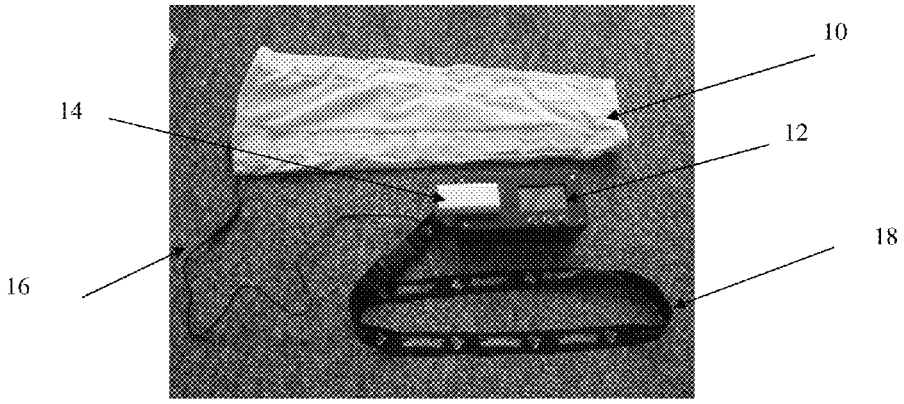
FIG. 1 shows a preferred embodiment of a mechanical vibration sleeve and controller according to the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

One particular application of the invention is a product that meets parameters for preventing bone density loss through the application of mechanical stimulation in the form of vibration. Mechanical stimulation can prevent bone density loss, and a sinusoidal stimulation applied at 40-60 Hz for approximately 30 minutes a day is preferred for bone density preservation. The mechanical stimulation is preferably applied by several unbalanced-mass motors (similar to cell phone vibrating motors) placed against a skin surface and, in one preferred embodiment, held against the skin by means of a comfortable, lightweight sleeve. The motors are controlled by a digital control system connected to a lanyard, which allows for convenient operation as the controller hangs comfortably from the user's neck. The controller allows for the adjustment of frequencies as necessary. In one embodiment, the apparatus is battery powered for at least thirty minutes, weighs less than 5 pounds, operates using 10V or less, and allows for full range of natural flexibility. Vibration at 40-60 Hz, 30 minutes a day, 5 days a week, for 3 months is believed to be effective in maintaining bone density levels.

Another particular application of the invention is the treatment or prevention of pressure ulcers. Pressure ulcers are distinguished by four different stages of degeneration. Stage 1 is characterized by a non-blanchable redness of intact skin. Stage 2 involves a loss of epidermal and possibly dermal skin layers. Stage 3 demonstrates full skin thickness loss and damage to subcutaneous tissue. Finally, stage 4 is characterized by severe tissue loss and damage to muscle, bone, tendon, and other supporting structures It is believed that blood flow can be substantially increased by localized low level vibrations at frequencies similar to those associated with muscle twitch. The ability to deliver stimuli such as vibration to the affected region allows the body to maintain blood circulation and nutrient transport, providing a means to prevent or treat pressure ulcers.

Vibration can be provided with several substantially different types of vibrators, including Nitinol actuators, unbalanced-mass motors, and piezoelectric actuators. Nitinol wires are relatively expensive, actuate slowly, and are difficult to work with. Piezoelectric actuators are easier to work with than Nitinol, but are brittle and require AC current to induce vibration. Unbalanced-mass DC motors are preferred over the other mechanisms because they are well suited for battery operation and their vibrating frequency can be adjusted by changing their operating voltage. Motor testing and analysis using a finite element analysis (FEA) package, indicate that the range of forces generated by unbalanced-mass motors overlap with the range of forces that could translate through the fat and tissues of the arm to the bone.

The motor is capable of producing at least 1 N of force, which the FEA analysis indicates is large enough to reach the bones. One suitable motor transmits a von Mises stress of approximately 0.06 psi to the cortical bone. The analysis also showed that there were no areas of constructive or destructive interference that would cause pain, damage to the arm, or negate the effects of the vibration. Because several DC motors capable of operating in the 40-60 Hz range will not start at the corresponding voltage from rest, they are instead started at a higher frequency and then their supply voltage is decreased until the desired 40-60 Hz range is reached.

Each motor is preferably housed in a motor housing designed to meet three requirements: allow the radial transmission of vibrations throughout the limb, eliminate the lateral forces of the motor, and protect the sleeve and user from the rotating mass. The housing design has additional space around the motor for damping material. This is to dampen the lateral forces from the motors to eliminate possible skin irritation. Housings have been rapid prototyped from SLA materials, and covers for the SLA housing portions have been created from ABS plastic and attached using epoxy. The housing covers may be provided with holes for sewing the housings onto a sleeve.

Damping material is injected into the motor housings on three sides of the motor with the motor flush against the bottom of the housing. This isolates the vibrations in the direction that has no damping material. The preferred embodiment of the sleeve consists of three separate layers. The first layer, which contacts the skin, is a plain compression sleeve which provides a washable barrier between the user and the motors. The second layer comprises cotton strips and compression material strips. The housings are sewn onto the cotton strips in rows of eight. These strips are then sewn in alternation with the compression material resulting in four cotton strips alternating with four compression strips. The top or outermost layer is another plain compression sleeve. This layer provides additional compression and contact between the motor housings and the user.

The motors are controlled by a controller in a separate case which may be attached to a lanyard that hangs from the user's neck during operation. A smaller, flexible housing for the controller is also contemplated. The controller includes an LCD screen having touch-interface functionality. The LCD screen displays a timer for the current session and includes touch buttons for starting, pausing, stopping, and resetting the current time. The apparatus is both portable and lightweight without hindering the user from completing normal tasks. The sleeve provides a relatively inexpensive and noninvasive way of providing stimulation to the bones of the body.

Low frequency vibrations should be avoided in order to protect the user from one of the body's natural frequencies. High frequency vibrations should be avoided for user comfort. Similarly, the magnitude of vibrational force should be kept to a minimum effective level, also for user comfort. However, the vibrational force has to be large enough to reach the bone or other targeted body portion. The housing and sleeve materials provide minimal damping to maximize the transferred vibrational force.

Table 1 below has a set of desired features more specific to reduction of bone density loss:

TABLE 1

| | |
|---|---|
| Less than 5 lbs. | Volume less than 40 dB |
| Apparatus conforms to 7.5" wrist and 13" elbow +(/− 15%) | Apparatus conforms to 16" shoulder and 15" bicep(+/− 15%) |
| Battery life of at least 30 minutes | One or more emergency shut off features |
| Eliminate risk of hitting 8 Hz natural frequency of the body | Operating voltage less than 10 volts |
| Allows up to 180° rotation of arm | Vibrates between 40-60 Hz |

Unbalanced masses on motors are preferred over nitinol and piezoelectric actuators as the vibration source based primarily on the pros and cons listed below in Table 2:

TABLE 2

| Vibration Method | Pros | Cons |
|---|---|---|
| Nitinol Actuator | Can undergo large deformations and still return to trained shape | Expensive, slow actuation |
| Unblanced Mass on Motor | Most common for intentional vibration, DC current, inexpensive | No major cons |
| Piezoelectric Actuators | Inexpensive, can produce large force, commonly used | Runs off AC current, brittle |

Additionally, certain aspects of the invention may be useful as an aid in fracture healing, osteoporosis prevention, and treating other bone density related ailments, and also in applications other than pressure ulcers that involve increasing blood flow.

A number of desirable attributes of embodiments of this invention are listed below:

1. Lightweight—Keeping the device lightweight causes the user to experience less fatigue and encumbrance during use.
2. Robust.
3. Comfortable fit—The material covering the user's body should be non-inhibitive and non-abrasive to avoid irritation of the skin and muscular processes during use.
4. Smooth/Continuous operation—The device should be capable of continuous operation for at least 30 minutes on a single charge for effective use.
5. Limited noise level during operation—Reducing the noise levels as much as possible prevents ear damage, irritation, and the overpowering of other audible sounds.
6. Flexible—The apparatus should allow for a complete range of motion so it does not hinder movement.
7. Variable Frequency—This is an added degree of flexibility easily incorporated with the nature of the apparatus's digital operation.
8. Safe (vibration levels)—Vibration levels of 0-8 Hz can be harmful to the body and should be avoided. Targeting the vibration levels to operate between 40 and 60 Hz eliminates the risk of encountering the natural frequencies of the body.
9. Safety features—These features will prevent the apparatus from malfunctioning and harming the user.
10. Accessible controls—The controls should be easily reached by the wearer.
11. Digital operation—Digital controls allow for the most accuracy of settings, flexibility of controls, and flexibility of user feedback.

An FEA model of a human arm was developed in order to aid in the frequency analysis of the vibrations. Finite element analysis was used on a 3D model of the arm in order to see how the vibrations propagated throughout the arm. This helps to account for the damping and response of the skin, fat, muscle, and bone. This model also helped to determine the preferred number of motors and helped dictate their placement on the sleeve. Their placement was optimized by ensuring that all of the bone was exposed to the force with minimal overlap of the forces.

A minimal amount of damping is desired from the housings and therefore the selection process is based on how well the housings transfer the vibrational load. Latex and silicone were considered as injection materials for the housings in order to secure the motors in place as well as dampening out some of the lateral vibrations of the housings. A compression sleeve is preferred for the sleeve on which the motors are mounted. Mounts for the motors and housing are provided to attach to the compression sleeve. The motor housings may be sewn to the sleeve.

An Arduino digital microcontroller may be used to aid in the control of the vibration. The Arduino is desirable because it provides more accuracy than an analog controller. A MOSFET is used in conjunction with the Arduino as an on/off switch and to help control the motor speed with pulse width modulation (PWM). The controller is designed to drive four different strips of motors in parallel on 50V or less, as discussed further below.

Figure 2:
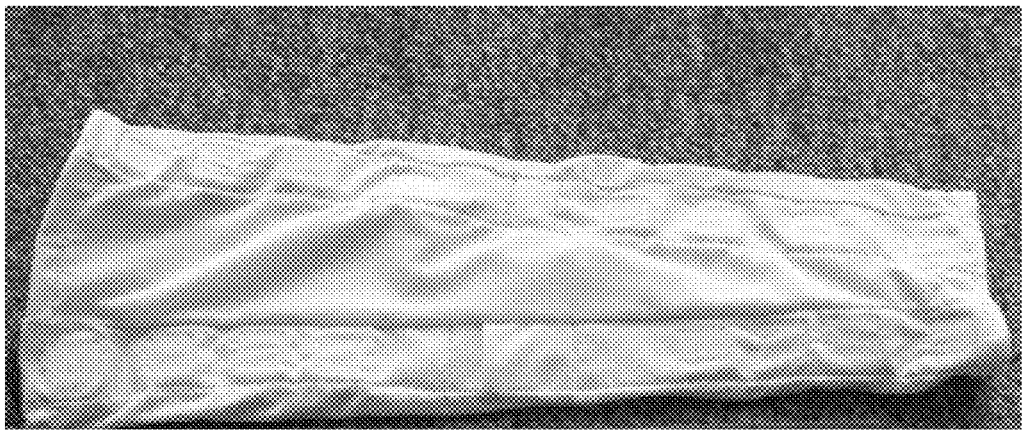
FIGS. 2 and 3 are close-up views of the sleeve and controller of FIG. 1, respectively.
Figure 3:
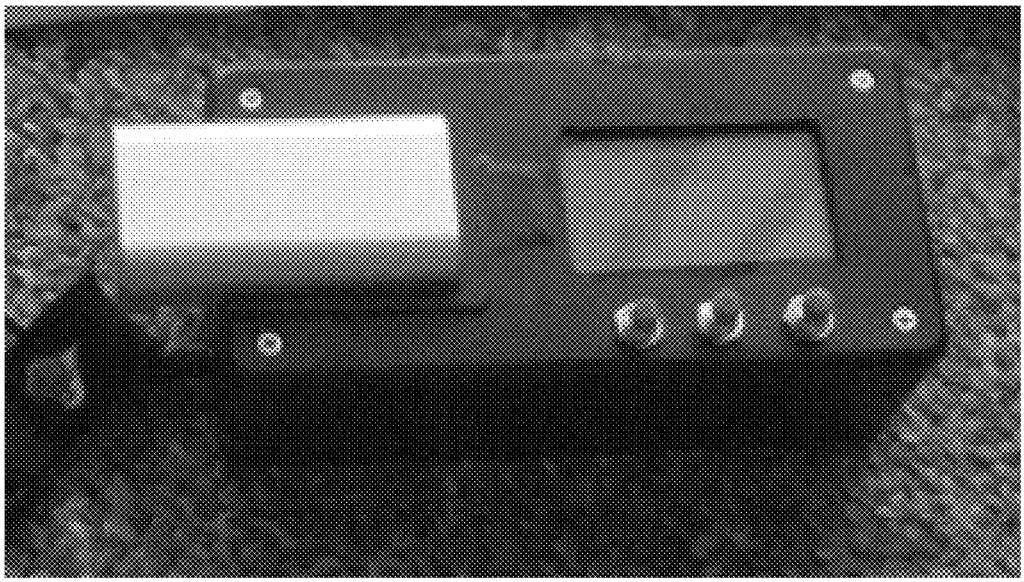
Figure 4:
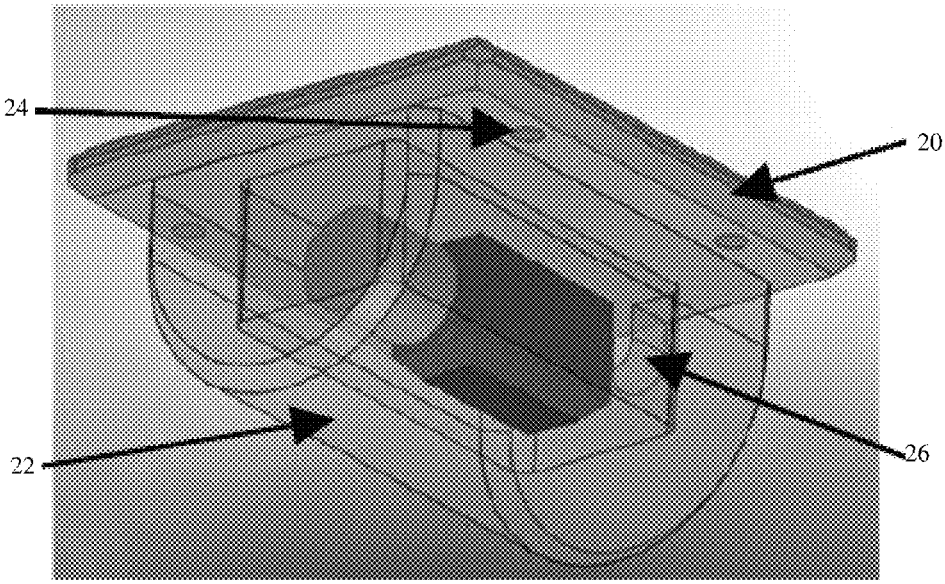
FIG. 4 is a drawing of one embodiment of a motor housing for use in the sleeve of FIG. 1.

A preferred embodiment of a mechanical vibration sleeve 10 and controller 12 according to the present invention is shown in FIG. 1. The sleeve and controller are shown enlarged in FIGS. 2 and 3, respectively. The controller includes an externally mounted detachable battery 14 and is connected to the sleeve by a cord 16 which supplies power to multiple unbalanced-mass motors provided in the sleeve as the source of vibration. The motor in one embodiment has a 0.9 gram mass press fitted on the motor shaft, and length and diameter of approximately 16 mm and 6 mm, respectively. Each motor is contained in a motor housing having a top piece 20 and bottom piece 22 as shown in FIG. 4. Four holes 24 are provided for sewing or otherwise attaching the housing to the sleeve, and the bottom piece includes a hole 26 for wire relief.

During assembly, the motors are placed in the bottom housing piece and silicone is injected around the sides of the motors with a syringe. This constrains the motors laterally and serves to dampen some of the lateral vibrations. The top housing is attached to the bottom piece via a 2-part epoxy. Each motor and housing is sewn into a strand of 8 motors. The sleeve, shown in more detail in FIG. 2 and discussed further below, includes 4 strands spaced 90° apart around the axis fixed to the centerline of the arm. Therefore, a total of 32 motors are included in the sleeve, connected in parallel as indicated above and together drawing approximately 1.28 A.

An FEA package was used to determine the optimal spacing of the motors. After the force output capability for a range of motors was determined, a finite element analysis was performed to determine the density of motors required to apply a reasonable load to the bones. The properties of human tissue were defined, which involved finding Young's modulus and Poisson's ratio for skin, fat, muscle, cortical bone, and cancellous bone. The values obtained and used for the analysis can be seen below in Table 3.

TABLE 3

| Tissue | Young's Modulus | Poisson Ratio |
|---|---|---|
| Skin/Fat/Muscle | 50 kPa | 0.4999 |
| Cortical Bone | 17 GPa | 0.4999 |
| Cancellous Bone | 50 kPa | 0.4999 |

The geometry of the forearm and upper arm were also defined based on a conservative estimation of size. The basic geometry used in the FEA analysis may be seen in FIGS. 6 and 7. The dimensions may be seen in Table 4 below.

TABLE 4

| Tissue | Upper Arm | Forearm |
|---|---|---|
| Skin/Fat/Muscle Radius (R1) | 5 cm | 3.5 cm |
| Cortical Bone Radius (R2) | 1.25 cm | .75 cm |
| Cancellous Bone Radius (R3) | 1.125 cm | .625 cm |

After defining basic geometry, dimensions, and material properties, boundary conditions and loads were added to the model. For a 3D model, at least one boundary of the model needs to be constrained in all three directions (x, y, and z) so that the model can be solved properly. For both the upper arm and the lower arm, the most intuitive boundary constraint is to constrain one end of the cortical bone in the x, y, and z directions. This represents how the arm is constrained to the body via the shoulder joint. The cortical bone is chosen as the constraint boundary since it is the most rigid, fixed material in the arm.

While the force from each motor causes the skin to slightly indent during a phase with the load directed into the arm, the motors are not affixed to the arm so as to pull the skin out during a load directed away from the arm. Therefore, to input a load value, a rectified half-wave signal of the following form is included in the model:

$$F=+0.5\sin(2\pi ft)\pm 0.5 \quad [1]$$

In Equation 1 the sign depends on the direction of the applied force, f is the excitation frequency, and time step t.

The analysis was completed at an excitation frequency of 50 Hz, since this falls in the middle of the desired range of 40-60 Hz. The time step was chosen to be t=0:0.004:0.02 (0:0.004:1/50), such that one entire cycle (or period) was included in the analysis.

Figure 8:
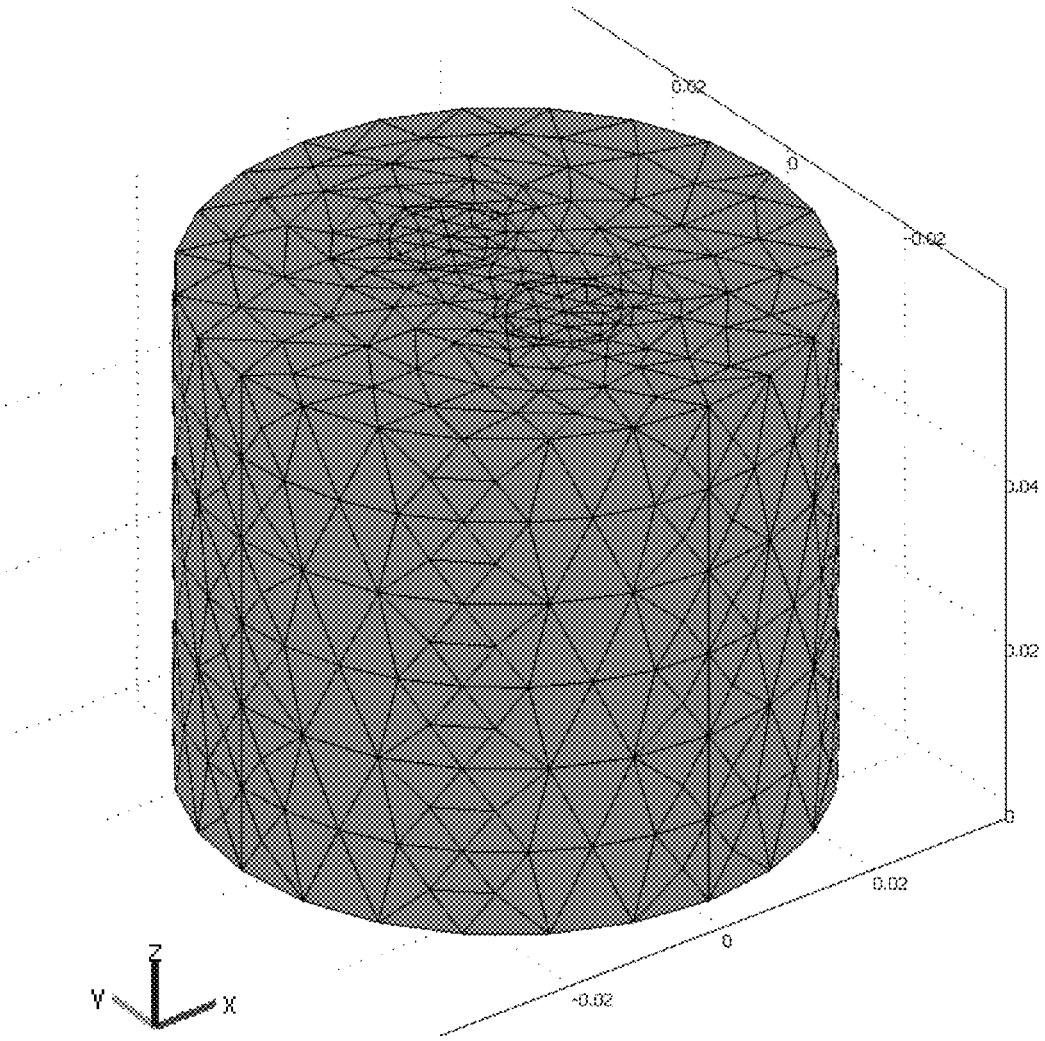
FIG. 8 illustrates a mesh used to generate the FEA model of FIG. 7.
Figure 9:
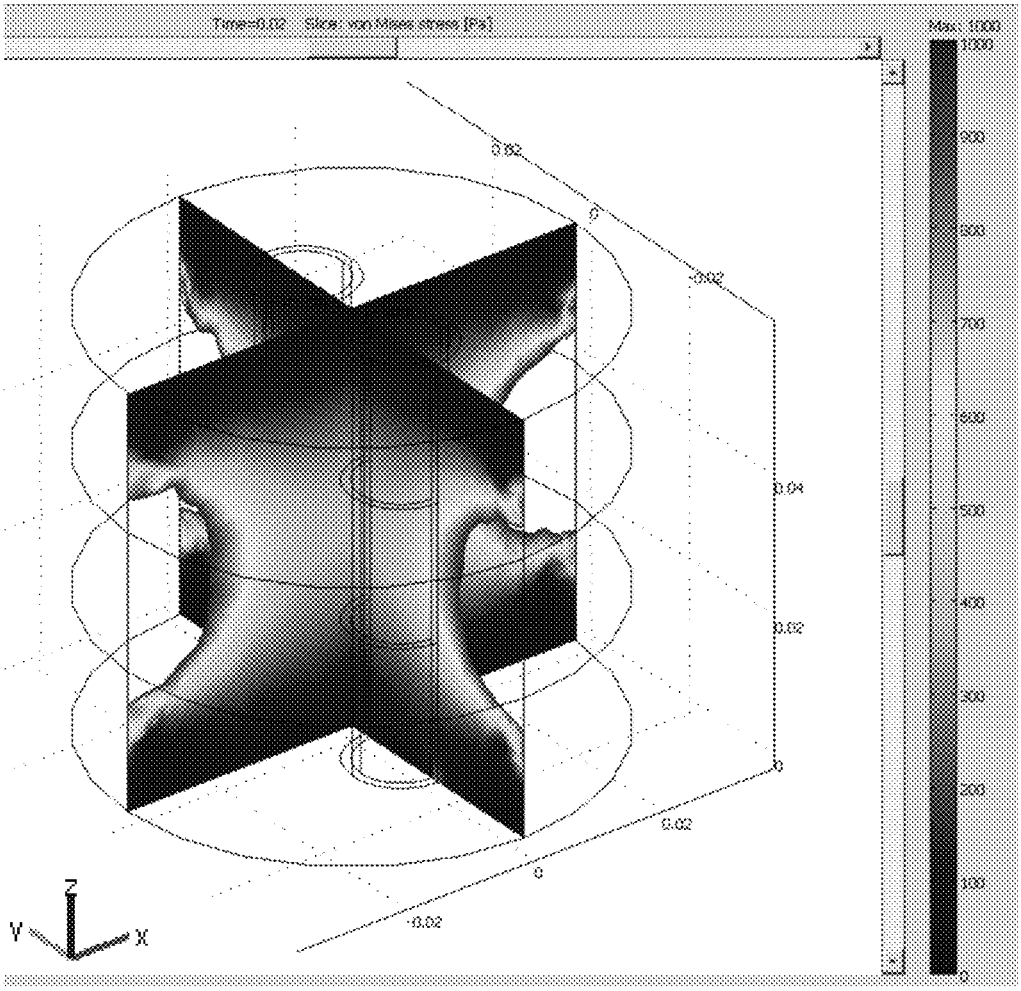
FIG. 9 illustrates a generated FEA model for the FEA model of FIG. 8.

The initial PEA models used the geometry seen above in FIGS. 6 and 7. FIG. 6 illustrates an initial finite element analysis (FEA) model for a segment of an upper arm. FIG. 7 illustrates an initial FEA model for a segment of a forearm. They were 6 cm and 10 cm segments of the upper arm and forearm with a motor placed in the center. The motor was modeled as a distributed load, which accounts for both the length of the motor itself and the housing it sits in. The load of the motor was applied along an edge to accommodate for the distributed load. Because of this, there are misleadingly high stresses at the point of application, since it is along the edge line. The models provided valuable information about the feasibility of using the range of motors tested, as it became apparent that a 1 Newton load would provide sufficient force to translate from the site of application to the cortical bone. The mesh used to generate the model may be seen in FIG. 8. The generated model of the forearm may be seen in FIG. 9 for one instance in time.

For this specific image, the von Mises stress range is limited to 0 to 1000 Pa (0 to 0.145 psi). Since this limit has been established, the areas where no von Mises stresses are present represent where the stress exceeds 1000 Pa. These are areas where the stresses are misleadingly high due to the edge line application of the load. The area of most interest is circled and demonstrates that the load translates to the cortical bone.

At this instance in time, the load on the bone is approximately 400 Pa (0.058 psi). This load causes no pain and is sufficiently below the ultimate tensile strength and yield strength of bone, which are 130 MPa and 105 MPa, respectively. Additionally, the spacing of the motors at every 2 cm is sufficient to ensure that the entire surface of the cortical bone is exposed to the load. Furthermore, there are no areas of constructive or destructive interference which hinder the performance of the motors or put the tissues at risk of pain or damage.

Figure 10:
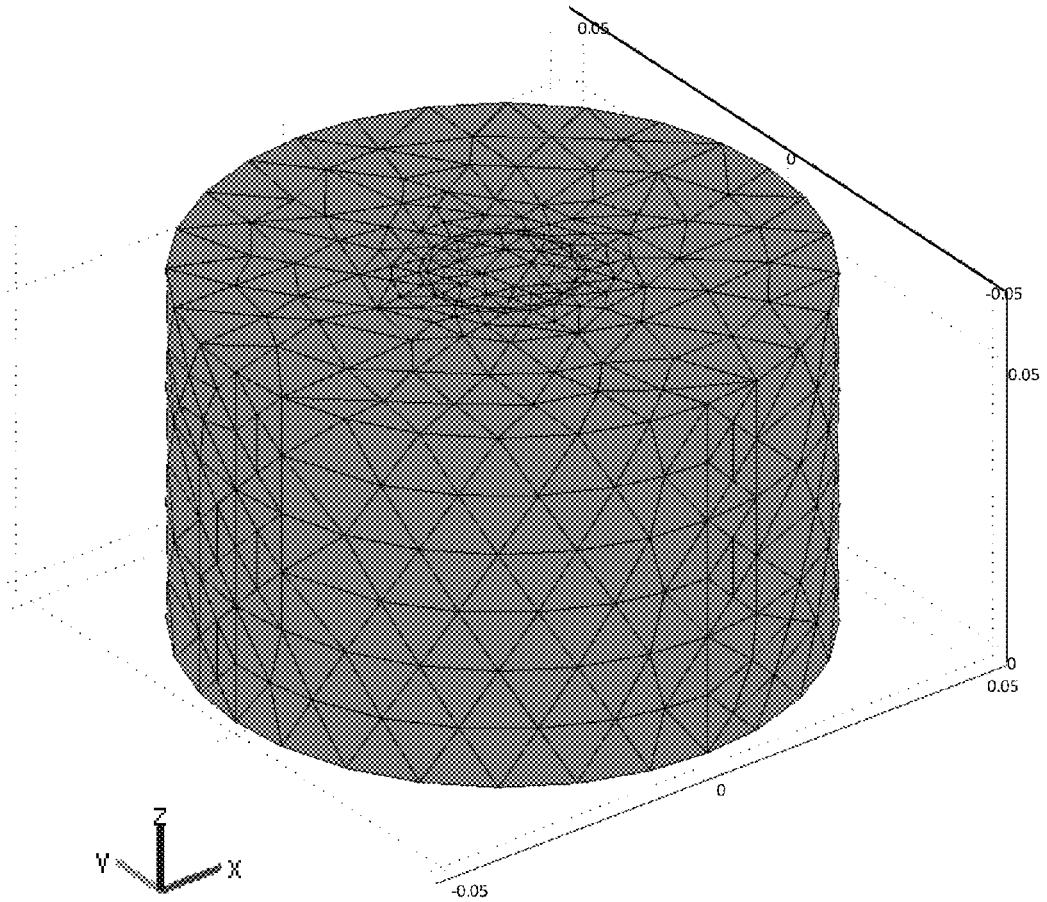
FIG. 10 illustrates a mesh for the FEA model corresponding to the FEA model of FIG. 6.
Figure 11:
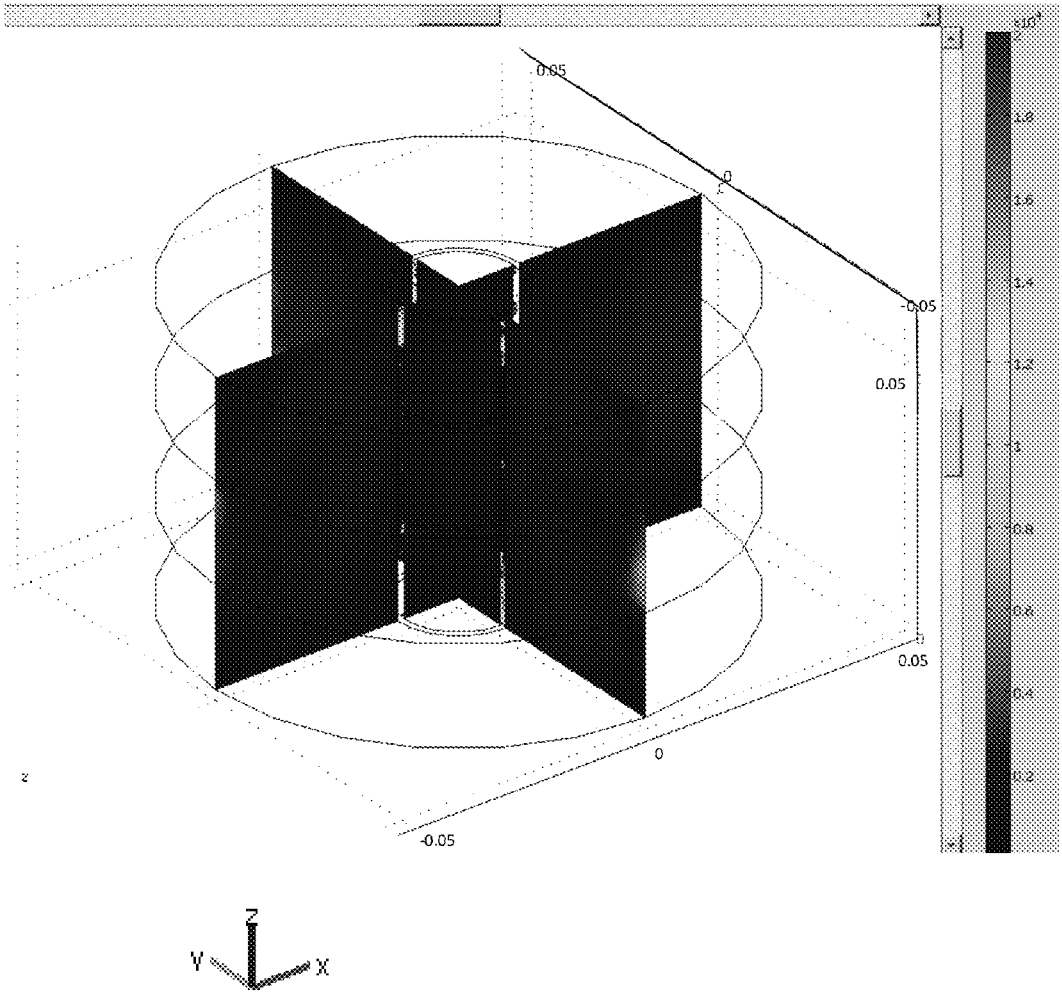
FIG. 11 illustrates a generated solution for the FEA model of FIG. 10.
Figure 12:
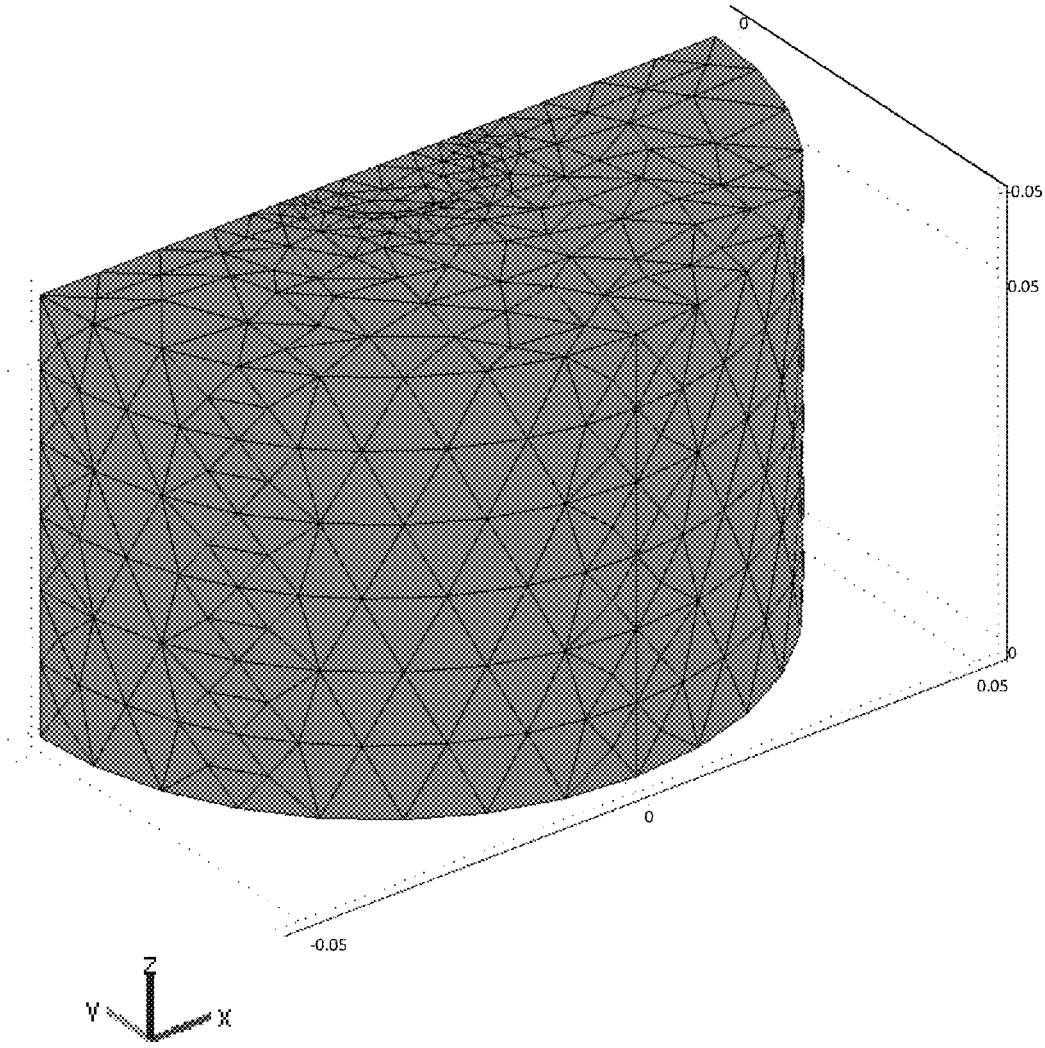
FIG. 12 illustrates a mesh for a FEA half-model corresponding to the FEA model of FIG. 6.
Figure 13:
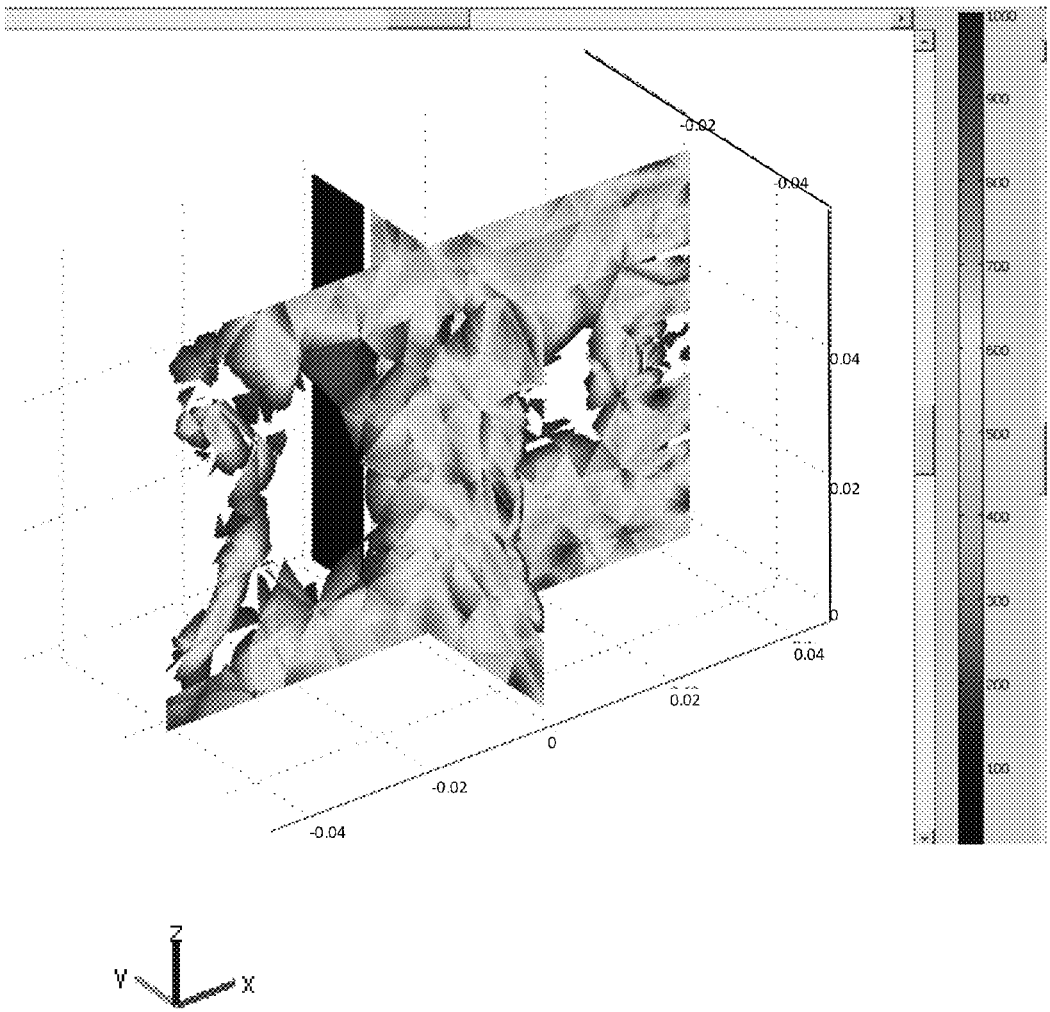
FIG. 13 illustrates a generated solution for the FEA half-model of FIG. 12.
Figure 14A:
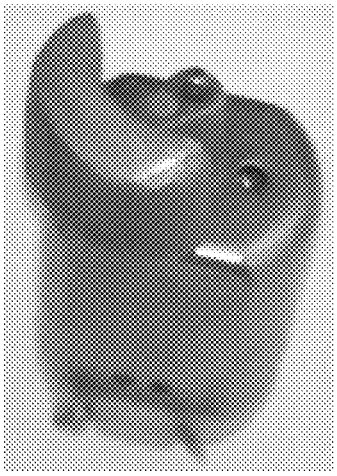
FIGS. 14A-E show example unbalanced-mass motors for use in mechanically inducing vibration in a body.
Figure 14B:
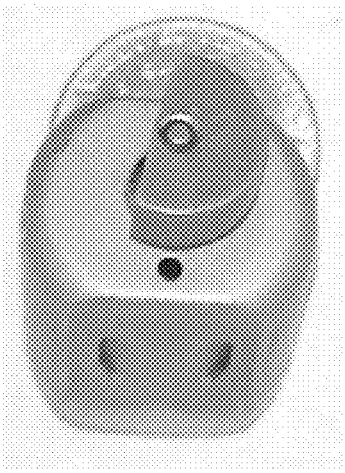
Figure 14C:
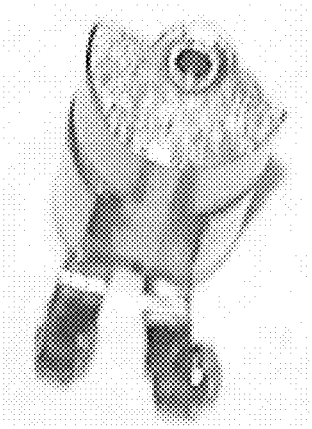
Figure 14D:
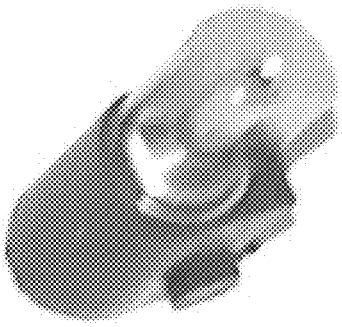
Figure 14E:
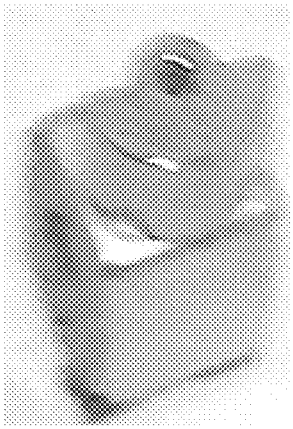
Figure 15A:
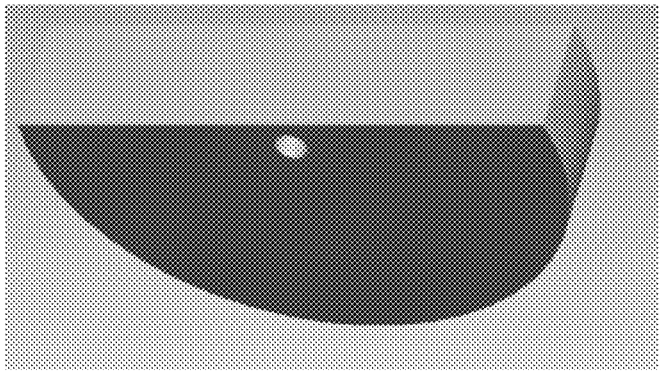
FIGS. 15A-D show CAD models of preferred masses for use on shafts of motors suitable for mechanically inducing vibration in a body.
Figure 15B:
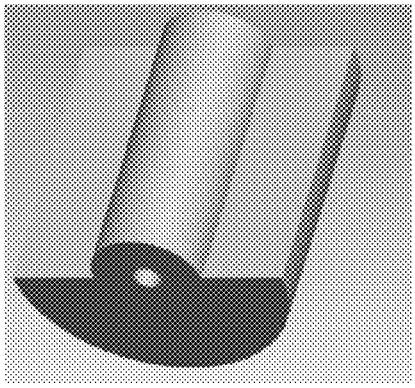
Figure 15C:
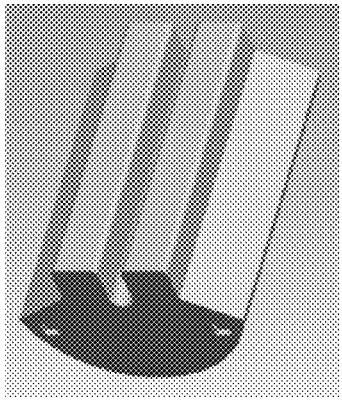
Figure 15D:
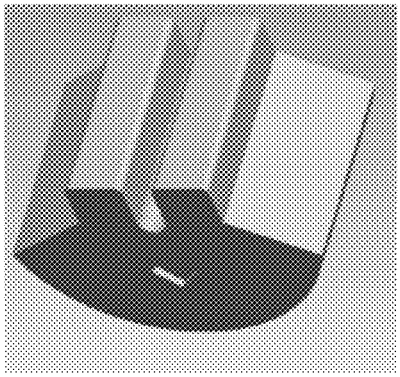

The mesh and generated solution for the initial geometry may be seen in FIGS. 10 and 11, and the mesh and corresponding solution for a half model may be seen in FIGS. 12 and 13.

An initial group of DC motors, shown in FIGS. 14*a-e*, was gathered from various sources including cell phones. Based on testing of these motors, a second group of motors was selected and identified as Motor Series A (for the largest sized motors) through Motor Series D (for the smallest sized motors).

The finite element analysis of the vibrations applied to the arm required the force provided from each motor in order to determine the quantity and placement of the motors along the arm. The equation for calculating the force from the rotational motion of the mass attached to the end of each motor shaft is shown in Equation 2 below.

$$F=mr\omega^2 \quad [2]$$

In order to determine the mass rotating at the end of each motor shaft, the masses had to be detached from their respective motor shafts. Most of the masses were press-fit onto the shafts and were pried off. Each mass was then measured to the nearest 0.1 gram using an Acculab V-1200, 1200 gram capacity scale. The geometry of each mass was measured with calipers and then modeled in Pro/Engineer. The value of r is the radial distance that the center of gravity is from the center of rotation. In this case the center of rotation is the motor shaft. ω is the angular velocity, i.e., the motor speed. The mass properties were calculated for each mass model. The results from these measurements are tabulated in Table 5 below.

TABLE 5

| | Motor Series | | | |
|---|---|---|---|---|
| | A | B | C | D |
| Mass (kg) | 6.50E-03 | 9.00E-04 | 6.00E-04 | 4.00E04 |
| r Measurement (m) | 3.25E-03 | 2.21E-02 | 1.82E-02 | 2.18E-02 |

Figure 16:
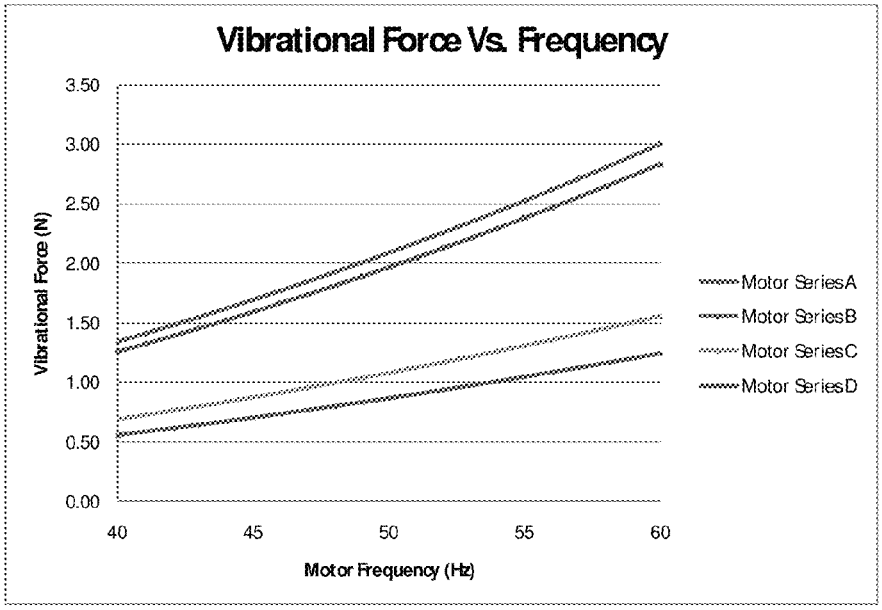
FIG. 16 is a graph of vibrational force vs. frequency for motors in a preferred group of motors suitable for mechanically inducing vibration in a body.

CAD models of each of the masses from the motors in Table 5 are shown in FIGS. 15*a-d*. Force calculations were completed for the preferred range of operating frequencies, and the results are shown in FIG. 16.

To test the motors' capabilities, an attempt was made with each motor to run at 50 Hz, well below the normal operating speed. It was discovered that the motors will not run at such low voltages from a standstill. However, the motors can be backed down from their operating speeds and will then run at 50 Hz. This was noted for Arduino programming purposes later. The motor operations can be seen in Table 6 below.

TABLE 6

| Motor | V | RPM | A | V @ 3000 rpm |
|---|---|---|---|---|
| B | 3.6 | 10500 | 24 | .55V |
| C | 3.6 | 9000 | 7 | — |
| D | 3.6 | 11000 | — | — |

Figure 5:
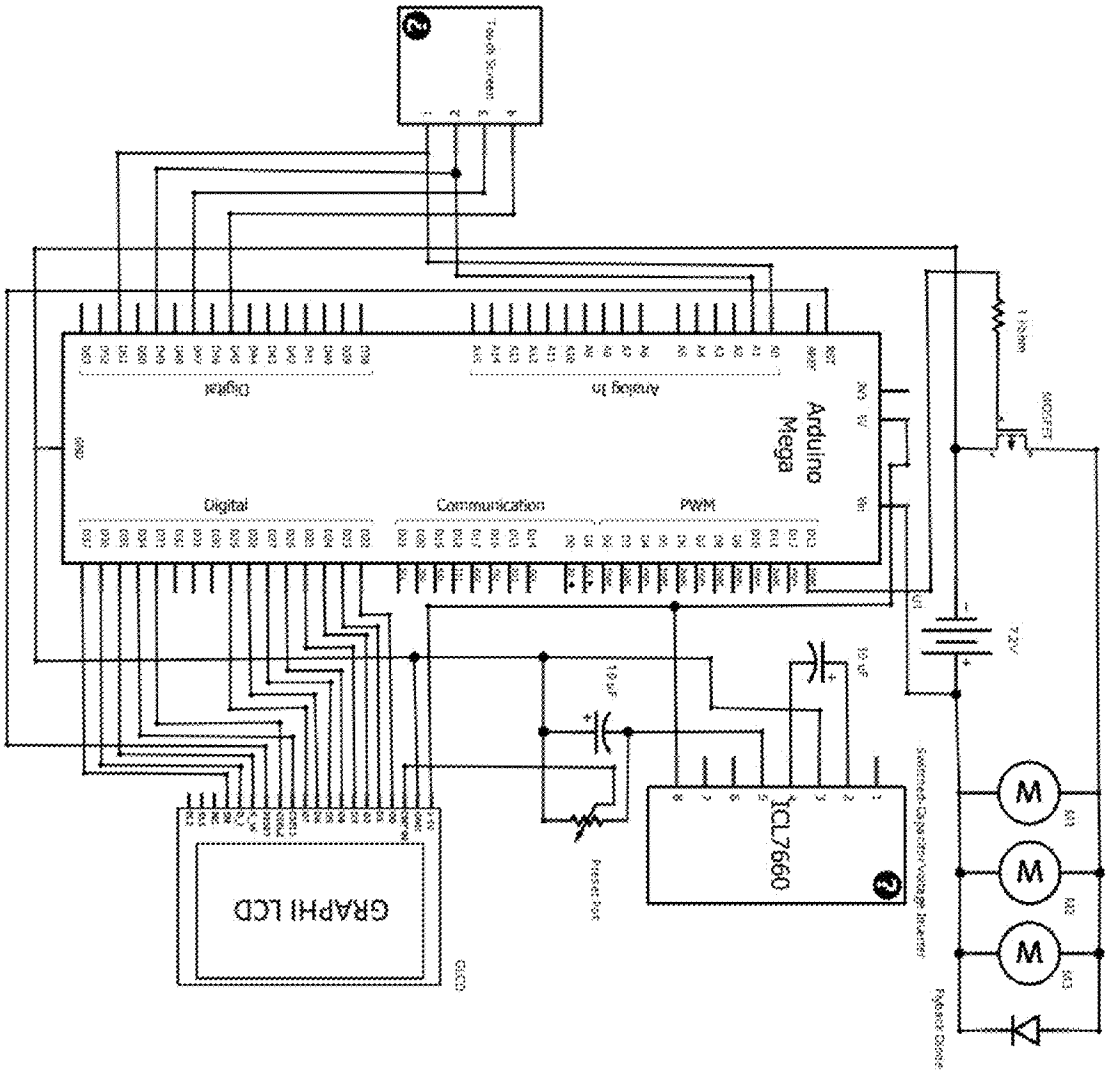
FIG. 5, broken into two parts 5A and 5B, is an electrical schematic of one embodiment of a motor control circuit according to the present invention.
Figure 5A:
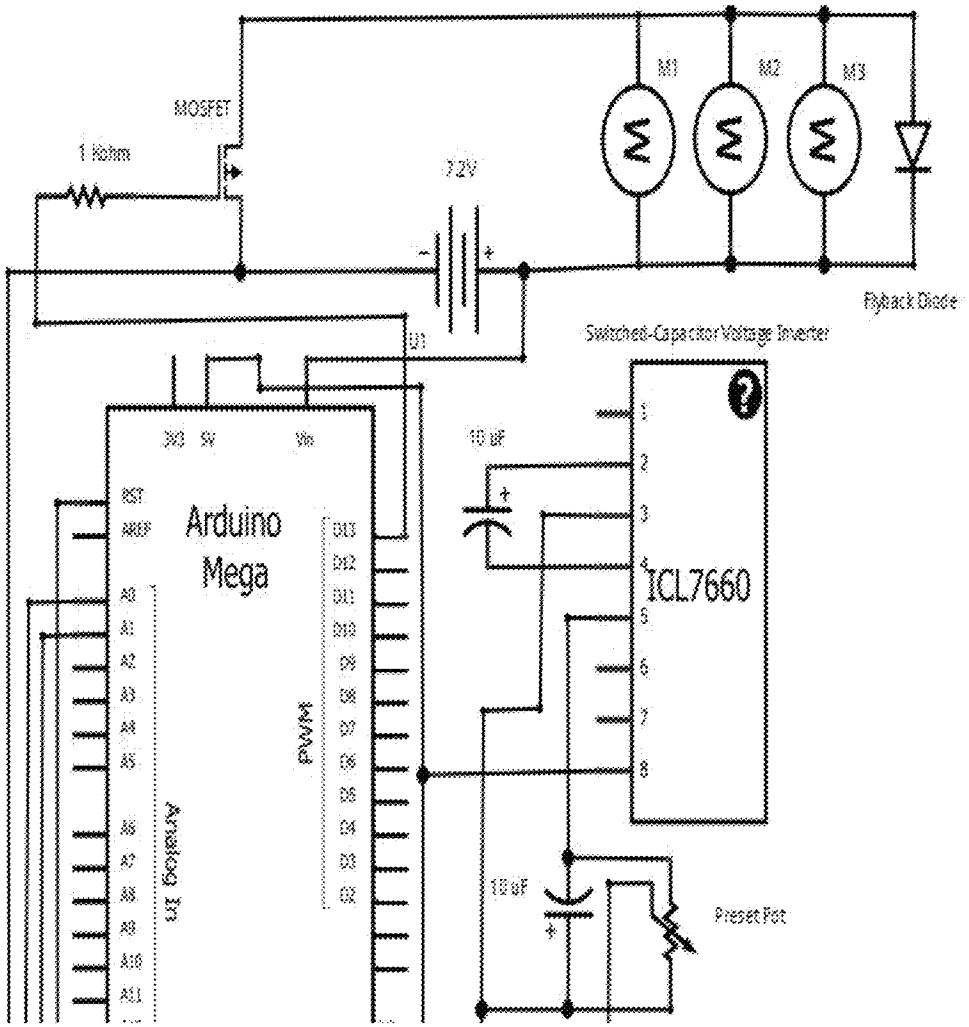
Figure 5B:
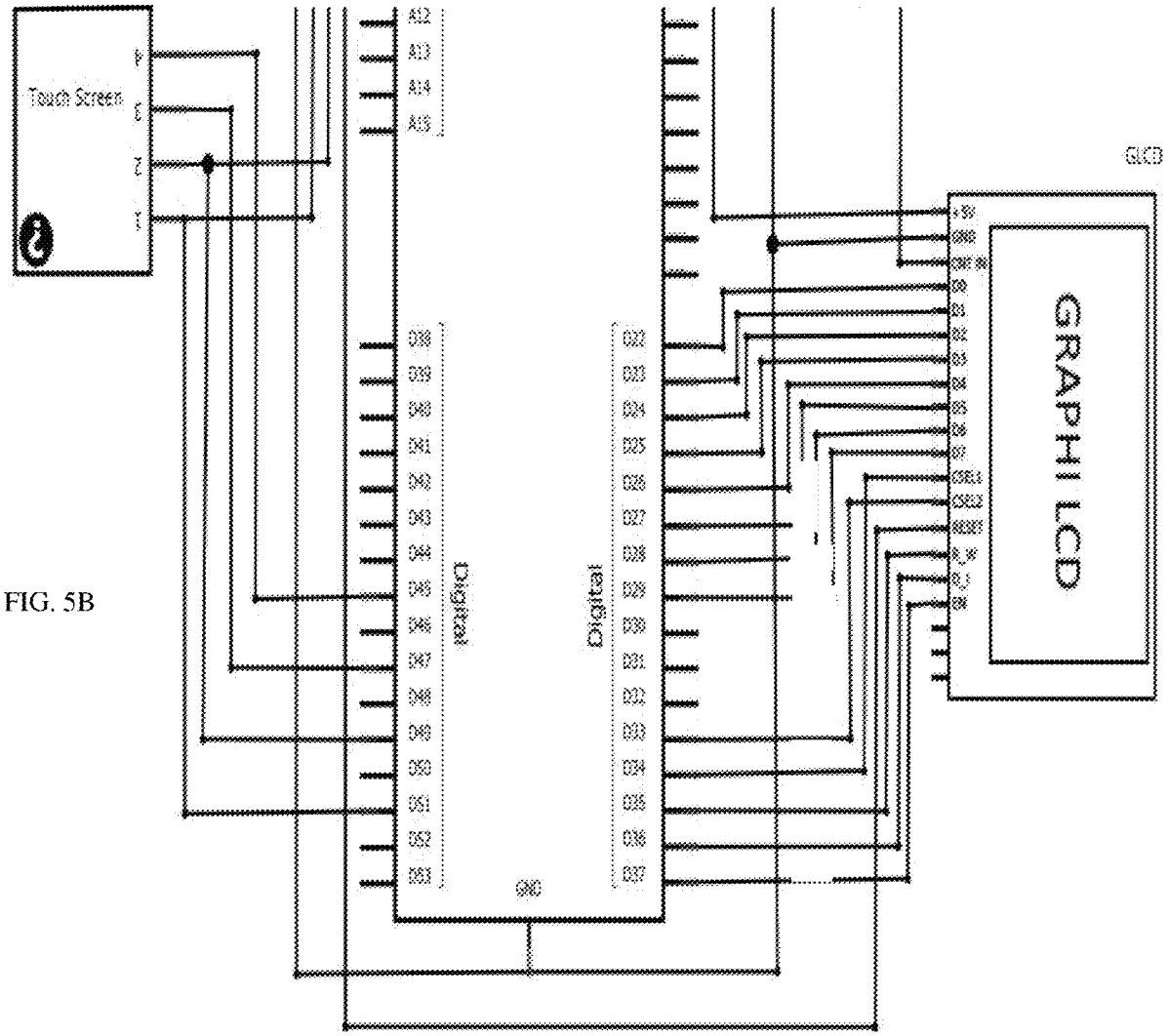

The controller of FIG. 1 comprises an Arduino Mega microcontroller, a 128×64 graphic LCD display, a resistive touch screen, a battery and a power MOSFET connected as shown in FIG. 5. The battery may be a 7.2V, 2000 mAh lithium ion camcorder battery detachably mounted on the exterior of the controller as shown in FIGS. 1 and 3 so that it may be easily detached and recharged. The motor sleeve also attaches and detaches from the controller.

The speed of the motors is controlled using a pulse width modulation (PWM) signal through a power MOSFET switch. By operating the switch with a PWM signal, the motor speeds are adjusted to a desired value. For example, a PWM duty cycle of approximately 16% causes the motors to operate at approximately 47 Hz.

The graphic LCD and touch screen panel provide a user interface for the controller. The graphic LCD uses the ks0801 driver, for which an open source functions library is available for the Arduino. The LCD requires a −3V input, and a switched capacitance voltage inverter is included in the circuit for that purpose. The LCD displays a timer and three primary buttons: start, pause, and reset. A resistive touch screen overlay is placed over the LCD display to provide x and y coordinate positions when the screen has pressure applied to it at a certain locations. The x and y coordinate readings are used to determine which button the user is pressing. Pressing the start button will start the timer and motors. Pressing the pause button will freeze the timer and stop the motors. The motors and timer can be re-enabled by pressing the start button again. Pressing the reset button temporarily stops the motors, and causes the display of a confirmation prompt for the user. If the user confirms the reset, the timer is reset, e.g., to 30 minutes, and the motors are turned off. If the user chooses not to reset, the display returns to the prior state (run or pause).

Table 7 shows estimates for the current draw from all 32 motors and the power dissipation across the MOSFET. Note that these estimates are worst case estimates, meaning all assumptions have been chosen to be on the larger side of the range of possible values. Most MOSFETs are easily capable of handling these amounts of current and power dissipation.

TABLE 7

| Current draw of one motor at 50 Hz | Current draw of 32 motors at 50 Hz | Power draw at 3 V (one motor) | Power draw at 3 V (32 motors) |
|---|---|---|---|
| 40 mA | 1.28A | 0.12W | 3.84W |
| | Power dissipation across MOSFET in 'on' state 33 mW | Power dissipation across MOSFET in 'switch' state 1.536 mW | |

Since certain motors are capable of running at 50 Hz but incapable of starting up at 50 Hz, the controller may be configured to initialize the motors at a slightly higher duty cycle than desired while they are running, then step the duty cycle down to the 50 Hz operating range. The duty cycle may be periodically stepped up if sudden motor stoppage occurs due to inertial forces from movement. Also, motor speed tends to vary based on the amount of pressure applied. If the motors are squeezed, their rotational speed will increase, whereas if the pressure is relinquished, they will slow. The housing is designed and assembled to accommodate this tendency and to maintain an appropriate pressure for a desired operating speed for each motor. Alternatively, or in addition, a feedback system may be incorporated to provide automatic speed control.

It is preferred to fully enclose the controller in a case and to fully enclose the motors in their housings so as minimize the potential for patient contact with electrical conductors, and the inner compression sleeve, which is underneath the sleeve to which the motors are attached, prevents possible wire-on-skin contact.

Figure 17:
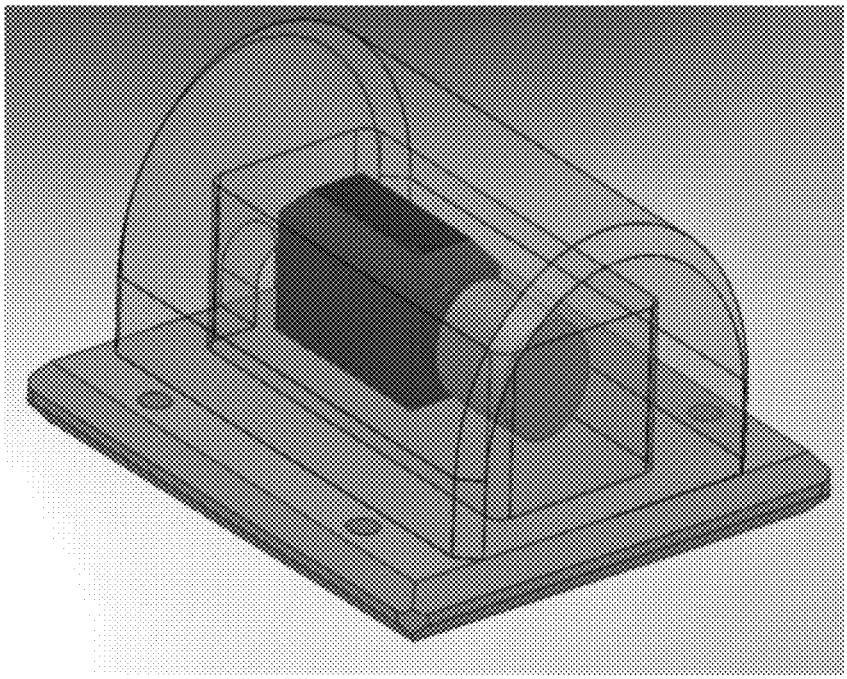
FIGS. 17 and 18A are additional views of one embodiment of a motor housing for use in the sleeve of FIG. 1.

The housing is a trap fit design. It is intended to hold the motor securely in place without attaching the motor directly to the housing. As noted above, the housing was designed to accomplish three things: allow radial transmission of vibrations into the arm; eliminate the lateral force of the motor; and protect the user from the rotating mass. During assembly, a motor is placed in the bottom part of the housing, which is shown in FIG. 17 with its bottom side up, and silicone is injected into the housing as a damping material to reduce or eliminate lateral vibrations. Silicone provided on the top of the motor also helps hold it in the proper orientation. The damping material on the side of the housing helps constrain the motor's side-to-side oscillation which could create potential skin irritation. The housing design leaves space for the silicone around the motor, and the top rectangular lid attaches to the bottom housing piece.

Figure 18A:
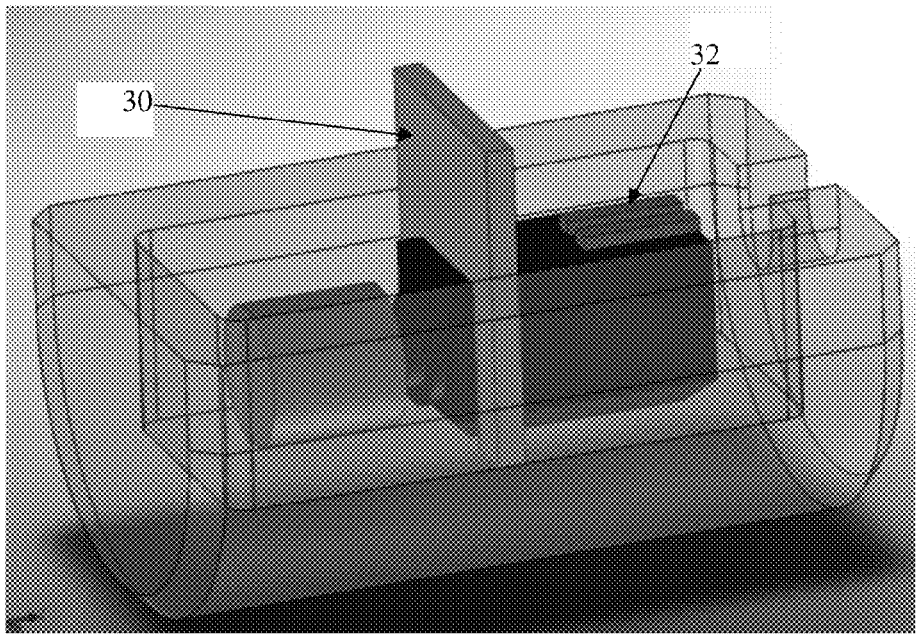
Figure 18B:
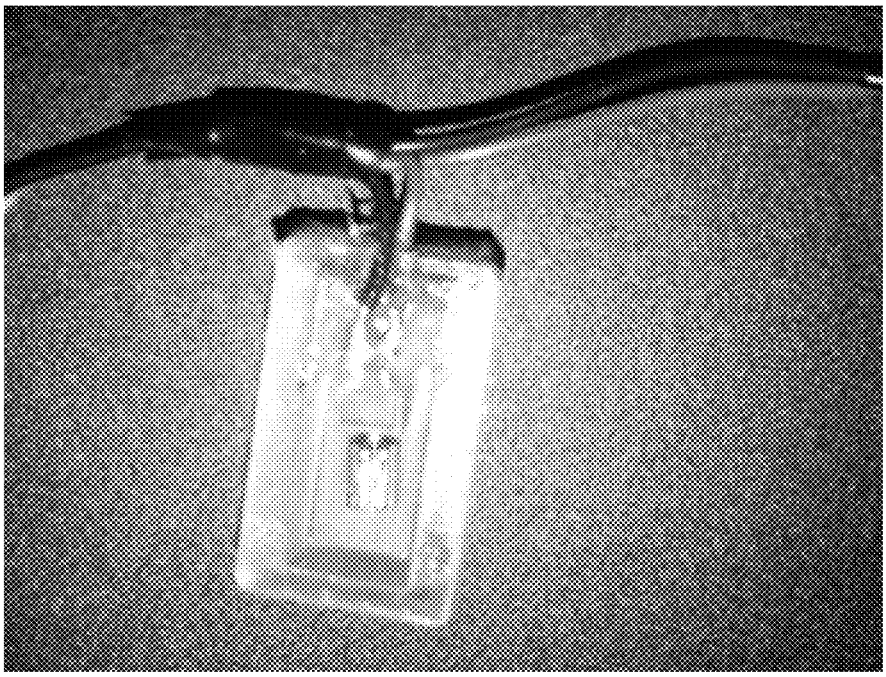
FIG. 18B shows one embodiment of a motor housing with silicone around a motor contained therein.

A plastic divider may be placed in between the silicone in recess 32 and the moving components of the motor during the invention molding process (see FIG. 18A). FIG. 18B shows the motor case embedded in silicone 23 in the housing.

The bottom housing piece is rounded as shown, e.g., dome-shaped or greenhouse-shaped, to try to minimize the area in contact with the skin which will increase the local normal stress and thereby facilitate transmission of the force from the motor to the bone. The bottom housing piece may be made of SLA plastic using a rapid prototyping process, and the top may be machined from ABS plastic bar stock. Holes for attaching the housings to the sleeve are drilled or otherwise provided in four locations as shown in FIGS. 4 and 17.

Figure 19:
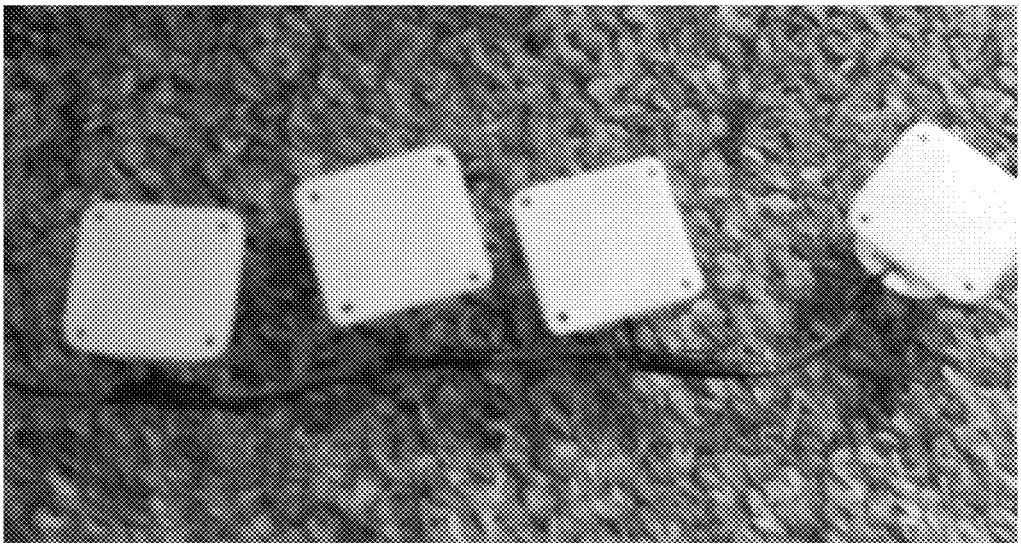
FIG. 19 shows a group of interconnected motor housing.

The top pieces of the motor housings may be temporarily attached with clamps during assembly to check if the motors run within the proper frequency ranges with the compression of the housing top. Once the operating speeds are satisfactorily checked, the housings are permanently sealing with epoxy. The covers are held in place with the same clamps during the curing process to achieve repeatable results. A finished housing group is shown in FIG. 19.

Figure 23:
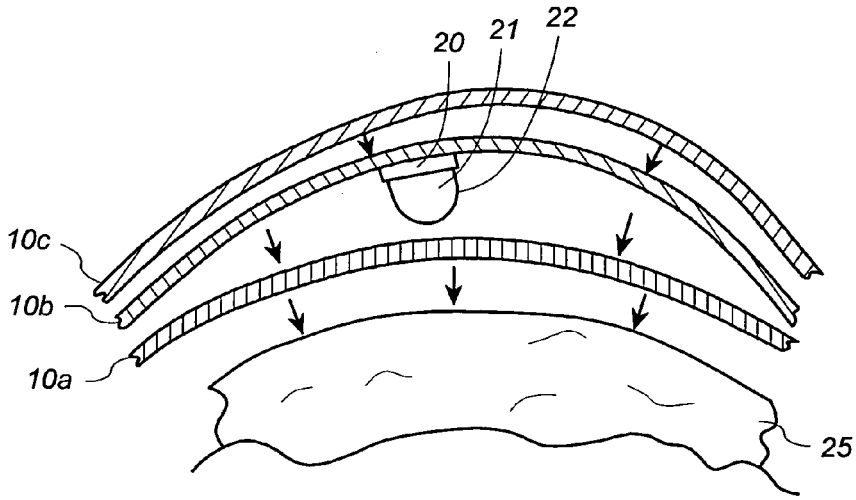
FIG. 23 shows a cutaway, exploded, schematic view of the multilayer sleeve.

FIG. 23 shows a cutaway, exploded, schematic view of the multilayer sleeve 10. The multilayer sleeve 10 has three separate layers 10*a*, 10*b*, and 10*c* as noted above: 1) a plain compression sleeve 10*a* as an innermost layer which provides a washable barrier between the user 25 and the motors 21; 2) a middle layer 10*b* comprising cotton strips and compression material strips sewn together; and 3) an outer layer 10*c* which may be another plain compression sleeve. The housings 20, 22 are sewn onto the cotton strips in rows of eight, and these strips are then sewn in alternation to the compression material strips resulting in 4 cotton strips alternating with 4 compression strips.

Figure 20:
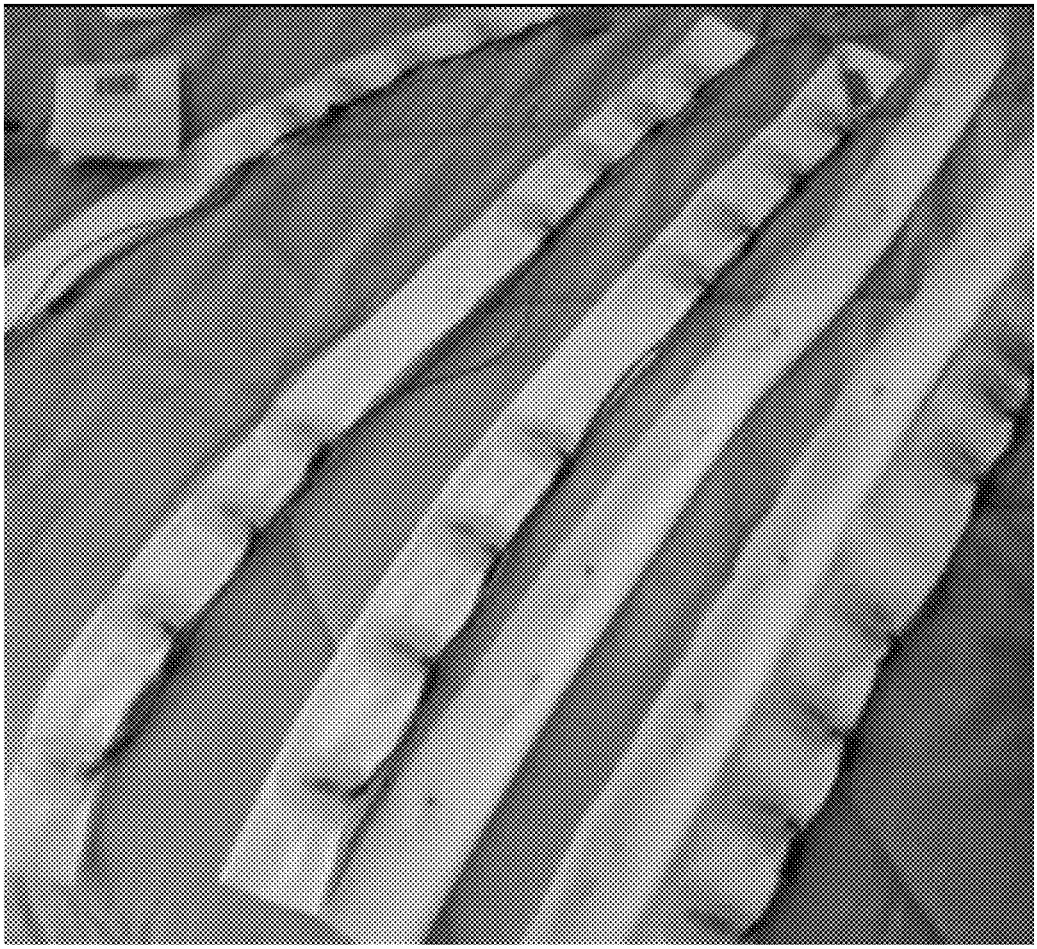
FIGS. 20-22 show parts of a sleeve at different stages in the fabrication process.
Figure 21:
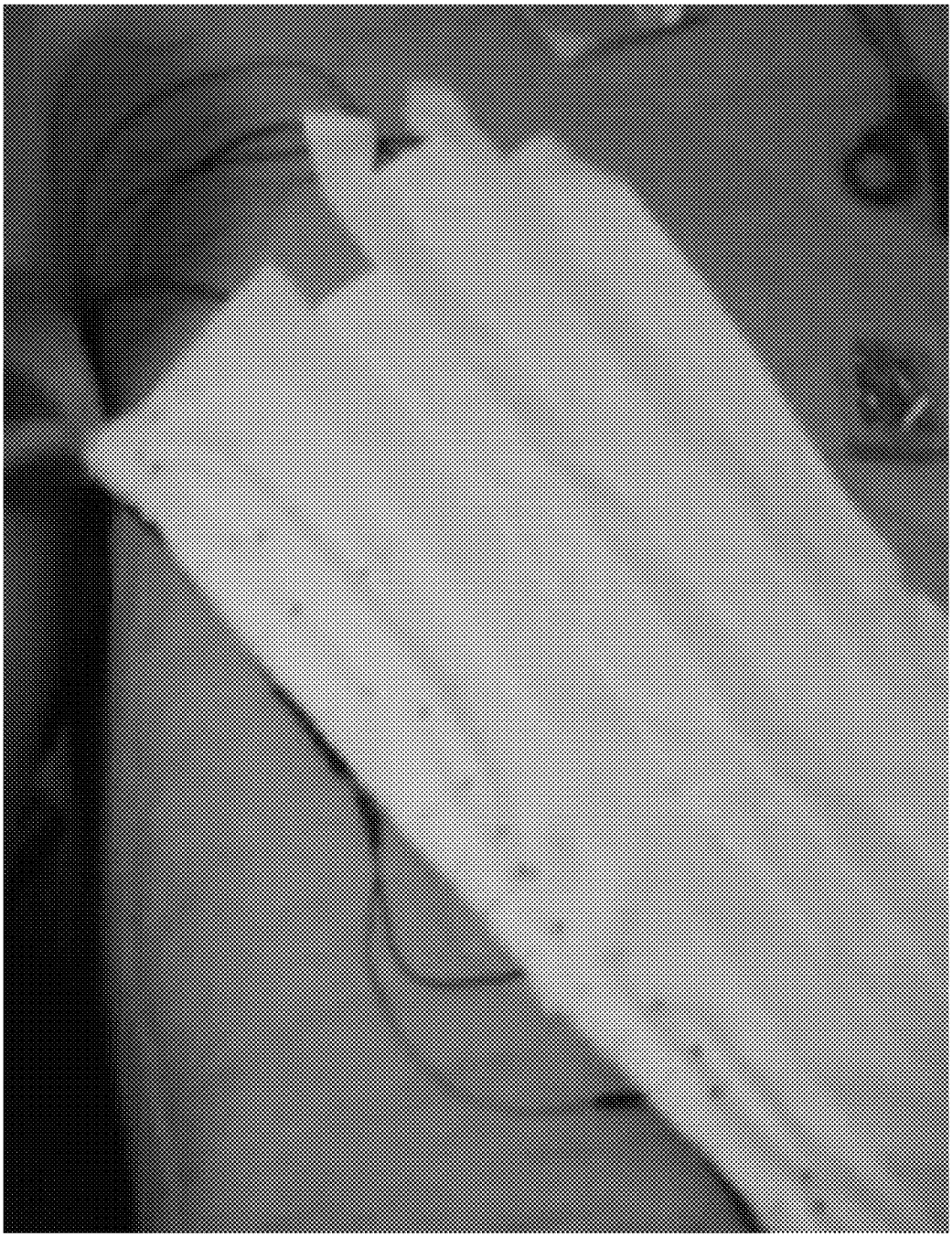
Figure 22:
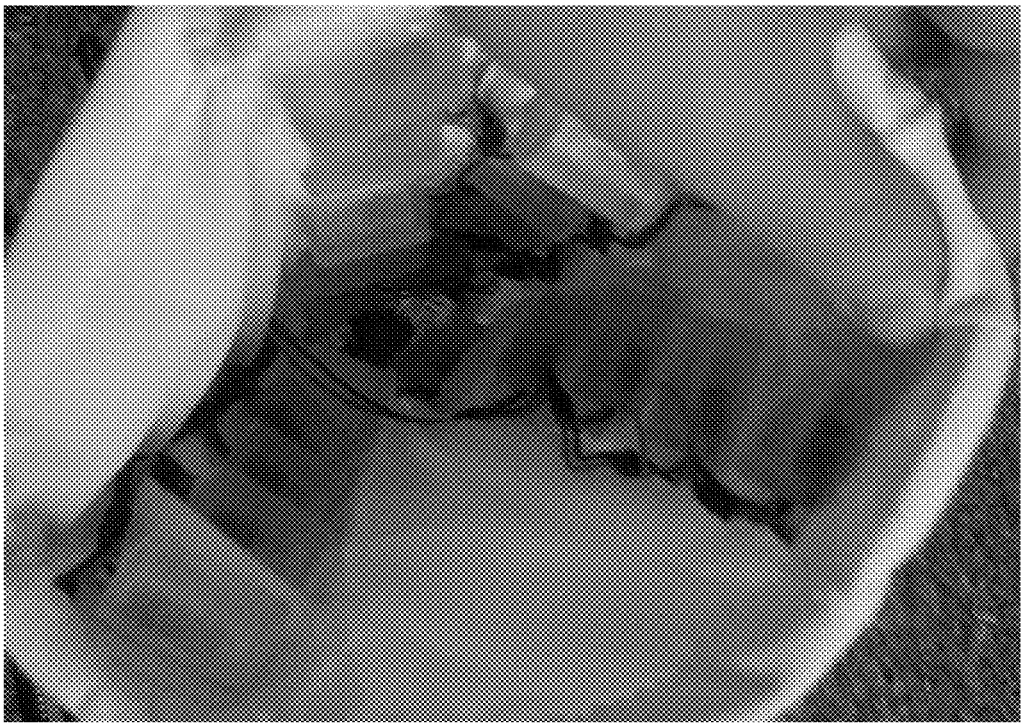

The sleeve components and fabrication process are illustrated in FIG. 20-22. The motors may have strips of cotton or other fabric on both sides thereof, as shown in FIG. 20, or on only one side.

The spacing of the motors was determined from the pattern and magnitude of force transmission in the arm. This pattern and the force magnitude was virtually tested by simulating the loading condition on the arm using finite element analysis. The results of the models suggested that the amount of load applied to the arm would be sufficient to reach the bones at a large enough magnitude. The results also suggested that 2" spacing between the motors in each strand would be appropriate in order to avoid overlapping forces from surrounding motors.

The design is light, portable, compact, and unobtrusive. The vibrating sleeve has low power consumption, and the touch screen interface allows for simple, user-friendly operation. The standalone controller unit includes an emergency stop switch and the easily removed power cord, which provides two methods for cutting all power to the sleeve. These methods enhance the safety of overall device. The LCD screen and touch screen on the control unit provide an easy way to control and monitor the time with a timer.

Clinical testing would use a simplified version of the current circuitry. An Arduino microcontroller was used for prototyping and design purposes but can be replaced with smaller devoted boards. For example, 555 timers could replace the timer function of the Arduino. Additionally, user interface features can be substituted for a simpler on/off switch. It is also contemplated to control the motors individually or in groups, and in particular to cycle the motors to mechanically induce vibration in a desired sequence so as to direct blood flow to specific parts of a target tissue or body part. Individual or group motor control may also be used to save power.

Also, manufacturing the housing may be switched over to injection molding. Injection molding for this large of a number would be a more economical manufacturing process. The housings can also have some remolding done to them to reduce weight and add other features like a larger hole around the mass of the motor.

While bone density preservation during space travel is a significant application of the invention, the medical market presents several other applications. For example, mechanical stimulation as described herein is contemplated to have therapeutic benefits for the ailments listed below.

treatment of osteoporosis fracture healing physical therapy of soft tissue injuries prevent reduced blood flow caused by peripheral arterial disease prevention and alleviation of bed sores treatment of cutaneous ulcers There are two primary ways this product is believed to deliver therapeutic benefits: encouraging bone growth according to Wolff's Law of Bone Remodeling, and increasing blood flow to injured areas. In the application to the previous ailments, the final product may have forms other than a sleeve.

Osteoporosis

Osteoporosis is characterized by the thinning of bones due to a depletion of calcium and protein. Osteoporosis significantly increases the risk of fracture, referred to as fragility fracture when caused by osteoporotic bone. Common fragility fractures that occur are in the hip, rib, vertebral column, and forearm. Osteoporosis is easy to diagnose, but difficult to treat. Treatments typically only involve ensuring an adequate amount of calcium intake, along with other minerals, such as Vitamin D, which encourage bone growth and hormone replacement therapy (HRT). The treatment and repeated screening is costly and time consuming, costing anywhere from $50-$100 per month depending on the therapy chosen, with noted short-term side effects and unknown long-term effects.

The product encourages protein synthesis and bone growth non-invasively and inexpensively by applying mechanical vibrations. This represents a onetime cost for the patient, who would wear the product once a day at his or her convenience. Daily activities can still be performed while using the product. Furthermore, this solution eliminates the side effects associated with hormone replacement therapy.

Osteoporosis treatment is a considerably large market in the medical sector. According to the International Osteoporosis Foundation, in 2010 in the United States about 12 million people over the age of 50 are expected to have osteoporosis and another 40 million to have low bone mass. By 2025, these numbers will increase to 14 million and 47 million, respectively. In 2005 in the USA, it was predicted over 2 million osteoporosis related fragility fractures occurred costing $17 billion. By 2025, this amount is predicted to increase by 50% and $25 billion, for a total of $50.5 million in annual osteoporosis fracture care. Not only could the product help treat and prevent osteoporosis, it may also decrease the cost of treating fragility fractures, the main side-effect of osteoporosis.

Fracture Healing and Soft Tissue Injury Therapy

The sleeve could be used to treat normal fractures (classified as musculoskeletal injuries for statistical purposes), fragility fractures, and non-union fractures. Musculoskeletal injuries are caused by anything from a sports injury to a work injury to an accident at home. Fragility fractures, as mentioned above, are a direct result of osteoporosis. Non-union fractures are fractures that take an extended period of time to heal or do not heal on their own. Non-union fractures may be due to the extent of fracture, the age of the patient (bone density decreases from aging), or other extenuating circumstances.

Currently, there are a few methods of treating musculoskeletal, fragility, and non-union fractures, including immobilization by brace or cast, intramedullary rods, plates, pins, wires, etc. With the exception of non-union fractures, these are all effective means of treating a fracture. However, they all have long recovery times that are dependent on location and the extent of the fracture. For extremity fractures, in general, bone callus forms anywhere from 4 to 6 weeks with full remodeling occurring at 18 months or more. Hip fractures have a longer recovery time. Extended recovery time requires multiple follow up examinations and potentially prevents the patient from returning to their daily routines.

The product offers a non-invasive and inexpensive method of expediting fracture healing. The current sleeve can provide mechanical stimulation to what was a completely immobilized musculoskeletal structure. The stimulation encourages bone growth, thus reducing the recovery time of the fracture. Most significantly, the sleeve should encourage healing of non-union fractures. Non-union fractures, as stated above, usually require a stimulus to heal. This is sometimes in the form of compression, by plating or pinning. These are very invasive solutions to the problem; whereas, the product provides a practical method of externally stimulating a non-union fracture to heal.

Fracture healing is another large medical market. According to the National Ambulatory Medical Care Survey, in 1998, 10.7 million musculoskeletal fractures were treated in the United States. In 2002, there were more than 54 million office visits from musculoskeletal injury. Furthermore, the average Worker's Compensation cost for absent work days was $10,500. Reducing recovery time could reduce these costs.

Soft tissue injuries are lumped into musculoskeletal injuries and are treated similarly to fractures. The injuries are treated with reconstructive surgery, braces, casts, slings, physical therapy, etc. Soft tissue injuries have a long recovery time and are generally difficult to treat. The sleeve could be used in the same manner as with fractures to reduce the recovery time of injury. The hypothesis is that the mechanical stimulation will increase the blood flow to the site of injury, thus aiding in the healing process. Additionally, bone growth will also be stimulated, increasing the bone density at the site of connection between soft tissue and bone. This should also reduce recovery time.

Reduced Blood Flow Associated with Peripheral Arterial Disease

Peripheral arterial disease (PAD) is a condition of the blood vessels characterized by narrowing and hardening of the arteries. This reduces blood flow to extremities necessary for normal function. The hardening of the arteries associated with PAD can damage the nerves in extremities, causing numbness or tingling. PAD is often seen as a complication of Type I and Type II diabetes.

Treatment involves exercising properly, wearing properly fit shoes, and often requires medication which prevents blood clots. In extreme cases, surgery may be necessary. The sleeve offers an additional non-invasive inexpensive treatment for this complication. The application of mechanical stimulation to the affected extremities could increase blood flow, preventing hardening of arteries. In the case in which the arteries have already begun to harden, the sleeve would increase blood flow protecting the nerves from further damage.

Bed Sores and Ulcers

Bed sores, also called decubitus ulcers, are characterized by skin damage from a lack of blood flow due to pressure. Bed sores typically occur in people who are bedbound, chair bound, or who are unable to reposition themselves. As a result bed sores are prevalent in hospitals and nursing homes. Common treatment for bed sores involves removing the pressure, cleansing the area, apply special dressing, and possibly surgery. Common sites for pressure sores are the coccyx, heels, elbows, and the iliac crest of the pelvis.

Preventing bed sores can be time consuming as it requires frequent monitoring and repositioning. The environments in which bed sores usually occur are in hospitals and nursing homes, and as a result repositioning is often overlooked due to understaffing. The sleeve could prevent both the occurrence of bed sores and even eliminate or reduce the time constraint usually associated with prevention. In this case, the motor housings could be oriented in a pad and then placed under the patient at the common sites for pressure sores. The mechanical vibrations will continuously change the pressure distribution on the body and even allow for air flow to the skin. This should prevent bed sores with less physical labor and time. The pads need only to be placed under the patient and the patient may activate the pads when necessary.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected.

REFERENCES

Incorporated Herein by Reference

Books

Callister Jr., William, Electronic Materials. Piezoelectrics. *Materials Science and Engineering, An Introduction*. John Wiley & Sons. 2005

Papers

J. Flieger, Th. Karachalios, et al. *Mechanical Stimulation in the Form of Vibration Prevents Postmenopausal Bone Loss in Ovariectomized Rats*. Laboratory for the Research of the Musculoskeletal System "Th. Garofalidis", KAT Hospital, Kifisia 14561, Athens, Hellenic Republic, Greece.

Jankovich, John P. The Effects of Mechanical Vibration on Bone Development in the Rat. Wnner-Gren Aeronautical Research Laboratory, University of Kentucky, Lexington Ky. 40506, U.S.A.

W. Qassem and M. 0. Othmant. *Vibration Effects on Setting Pregnant Women-Subjects of Various Masses*. Hijjawi Faculty for Applied Engineering, Yarmouk University, I&id, Jordan; and Department of Mechanical Engineering, The Jordan University of Science and Technology, Irbid, Jordan. Piezoelectrics in Positioning: Tutorial on Piezotechnology in Nanopositioning Technologies. *PI* 2009 *Piezo Tutorial*. Piezo University.

Patents

Implantable Microstimulator System for Producing Repeatable Patterns of Electrical Stimulation. U.S. Pat. No. 6,175,764 B1. Date of patent: Jan. 16, 2001.

Functional Electrical Stimulation for Pressure Sore Inhibition. U.S. Pat. No. 4,727,878. Date of patent: Mar. 1, 1988.

Websites

Rasmussen. G. Human Body Vibration Exposure and Its Measurement. http://www.Zainea.comlbody.htm G. Forrest Cook 1999. http://www.solorb.com/elect/solar-circ/pwm1/ http://www.iofbonehealth.org/facts-and-statistics.html#factsheet-category-23 http://www.ncbi.nlm.nih.gov/pubmed/16525173 http://www.usbjd.org/research/research_op.cfm?dirID=211 http://www.schwebel.com/practice/broken-bone-injuries/statistics/ http://www.americanheartorg/downloadable/heart/1198011637413FS26PADOS. REVdoc.pdf http://www.merck.com/mmhe/secJ8/ch205/ch205a.html
http://www.nationmaster.com/graph/mor_dec_ulc-mortality-decubitus-ulcer
http://www.bedsorefaq.com/how-many-hospital-patients-suffer-from-bed-sores/World of Microcontrollers and Microprocessors.
http://www.8051projects.net/pulse-width-modulation/

We claim:

1. An apparatus for providing therapy to a living body using mechanically induced vibration, comprising:

a multilayer garment configured to generally conform to the shape of a portion of the living body, said garment having a first layer adapted for skin contact and a second layer over said first layer;

a plurality of motor housings attached to said second layer of said garment; and a plurality of unbalanced-mass motors respectively mounted within said plurality of motor housings with the rotational axis of each unbalanced-mass motor substantially parallel to a surface of said second layer such that vibrational forces generated by each motor are adapted to be substantially perpendicular to the underlying skin surface during use;

wherein each of said plurality of motor housings includes damping material configured to dampen forces in a direction lateral to the underlying skin surface more than in a direction substantially perpendicular to the underlying skin surface.

2. The apparatus of claim 1, wherein said second layer has inner and outer surfaces and said housings are mounted on said inner surface of said second layer.

3. The apparatus of claim 2, wherein said garment further includes a third layer over said second layer.

4. The apparatus of claim 3, wherein said first and third layers are washable compression sleeves, and wherein the first and third layers are detachable from said second layer.

5. The apparatus of claim 1, wherein said motor housings each have a bottom portion with a convex outer shape and an inner chamber sized and shaped to retain the motor mounted therein and leave space for said damping material alongside and above the motor other than around its output shaft and unbalanced mass, and a substantially flat cover on said bottom portion, said cover oriented toward said inner surface of said second layer and said convex bottom portion adapted to be oriented toward the skin.

6. The apparatus of claim 5, wherein said motors have axial spacing of approximately 2 cm and circumferential spacing of approximately 90° within said multi-layer garment.

7. The apparatus of claim 6, wherein said motors are DC motors, further comprising a controller configured to drive said motors in parallel with a PWM drive voltage which determines motor speed.

8. The apparatus of claim 7, wherein said controller is configured to operate said motors at a speed in the range 30-60 Hz, and wherein said controller is configured to operate said motors so as to produce loading on the order of 0.05-0.15 psi on a targeted body portion.

9. The apparatus of claim 8, wherein said controller is configured to operate said motors at 40-60 Hz, and such that the loading on the targeted body portion is approximately 0.06 psi.

10. A noninvasive method of treating or preventing pressure ulcers, comprising:

mechanically inducing a therapeutic level of vibration within a portion of a living body in need of treatment for pressure ulcers or susceptible to pressure ulcers, using a plurality of unbalanced-mass motors distributed about the skin surface of the affected body portion, with the rotational axis of each unbalanced-mass motor substantially parallel to the underlying skin surface such that vibrational forces generated by each motor are substantially perpendicular to the underlying skin surface; and damping any vibrational forces substantially parallel to the underlying skin surface more than vibrational forces substantially perpendicular to the underlying skin surface.

11. The method of claim 10, wherein said motors are held against the skin surface by a multilayer sleeve configured to generally conform to the shape of the affected body portion, said sleeve having a first layer adapted for skin contact and a second layer over said first layer;

said method further comprising:

transmitting the vibrational force from each motor to a limited contact area on the skin surface so as to increase the local normal stress.

12. The method of claim 11, wherein said motors are attached to said second layer, said sleeve further includes a third layer over said second layer, and said first and third layers are washable compression sleeves detachable from said second layer.

13. The method of claim 12, further comprising:

wherein said damping includes using silicone as a damping material.

14. A noninvasive method of inhibiting bone density loss, comprising:

mechanically inducing a therapeutic level of vibration within a portion of a living body susceptible to bone density loss, using a plurality of unbalanced-mass motors distributed about the skin surface of the susceptible body portion, with the rotational axis of each unbalanced-mass motor substantially parallel to the underlying skin surface, and each motor mounted such that vibrational forces generated by each motor are greater in a substantially perpendicular direction to the underlying skin surface than in any lateral direction to the underlying skin surface.

15. The method of claim 14, wherein said motors are held against the skin surface by a multilayer sleeve configured to generally conform to the shape of a susceptible body portion, said sleeve having a first layer adapted for skin contact and a second layer over said first layer;

said method further comprising:

transmitting the vibrational force from each motor to a limited contact area on the skin surface so as to increase the local normal stress.

16. The method of claim 15, wherein said motors are attached to said second layer, said sleeve further includes a third layer over said second layer, and said first and second layers are washable compression sleeves detachable from said second layer.

17. The method of claim 15, further comprising:

damping lateral forces from said motors so as to reduce skin irritation.

18. A noninvasive method of treating soft tissue injuries, comprising:

mechanically inducing a therapeutic level of vibration within a portion of a living body in need of treatment for a soft tissue injury, using a plurality of unbalanced-mass motors distributed about the skin surface adjacent to the soft tissue injury, with the rotational axis of each unbalanced-mass motor substantially parallel to the underlying skin surface such that vibrational forces generated by each motor are substantially perpendicular to the underlying skin surface; and damping any vibrational forces substantially parallel to the underlying skin surface more than vibrational forces substantially perpendicular to the underlying skin surface.

19. A noninvasive method of treating peripheral arterial disease, comprising:

mechanically inducing a therapeutic level of vibration within a portion of a living body in need of treatment for peripheral arterial disease, using a plurality of unbalanced-mass motors distributed about the skin surface of the affected body portion, with the rotational axis of each unbalanced-mass motor substantially parallel to the underlying skin surface such that vibrational forces generated by each motor are substantially perpendicular to the underlying skin surface; and damping any vibrational forces substantially parallel to the underlying skin surface more than vibrational forces substantially perpendicular to the underlying skin surface.

20. A noninvasive method of treating a bone fracture, comprising: mechanically inducing a therapeutic level of vibration within a fractured bone in a living body, using a plurality of unbalanced-mass motors distributed about the skin surface adjacent to the fracture, with the rotational axis of each unbalanced-mass motor substantially parallel to the underlying skin surface such that vibrational forces generated by each motor are substantially perpendicular to the underlying skin surface; and damping any vibrational forces substantially parallel to the underlying skin surface more than vibrational forces substantially perpendicular to the underlying skin surface.

* * * * *